US008495789B2

(12) United States Patent
Nicolaou et al.

(10) Patent No.: US 8,495,789 B2
(45) Date of Patent: Jul. 30, 2013

(54) SURFACE TREATING APPLIANCE

(75) Inventors: Richard David Nicolaou, Malmesbury (GB); Thomas James Dunning Follows, Malmesbury (GB); Ashley Walter Symes, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 292 days.

(21) Appl. No.: 13/162,290

(22) Filed: Jun. 16, 2011

(65) Prior Publication Data

US 2012/0000029 A1 Jan. 5, 2012

(30) Foreign Application Priority Data

Jun. 30, 2010 (GB) ..... 1010955.1

(51) Int. Cl.
*A47L 9/10* (2006.01)

(52) U.S. Cl.
USPC ..... 15/352; 15/347

(58) Field of Classification Search
USPC ..... 15/347, 352, 353, 300.1; 55/429, 55/549.1, DIG. 3
See application file for complete search history.

(56) References Cited

U.S. PATENT DOCUMENTS

| | | | |
|---|---|---|---|
| 2,521,380 | A | 9/1950 | Lichtenfels |
| 2,553,175 | A | 5/1951 | Davenport et al. |
| 2,643,737 | A | 6/1953 | Bowers et al. |
| 7,497,899 | B2 | 3/2009 | Han et al. |
| 7,651,544 | B1 | 1/2010 | Fester et al. |
| 2008/0047091 | A1 | 2/2008 | Nguyen |
| 2008/0264015 | A1 | 10/2008 | Oh et al. |

FOREIGN PATENT DOCUMENTS

| | | |
|---|---|---|
| DE | 23 31 784 | 1/1975 |
| DE | 37 02 269 | 8/1988 |
| EP | 0 042 723 | 12/1981 |
| EP | 0 476 169 | 3/1992 |
| EP | 1 136 028 | 9/2001 |
| EP | 2 052 659 | 4/2009 |
| GB | 2 455 211 | 7/2008 |
| JP | 43-18948 | 8/1968 |
| JP | 10-180148 | 7/1998 |
| JP | 2006-88139 | 4/2006 |
| WO | WO-2009/104959 | 8/2009 |

OTHER PUBLICATIONS

International Search Report and Written Opinion mailed Sep. 15, 2011, directed to International Application No. PCT/GB2011/051241; 12 pages.

GB Search Report dated Oct. 22, 2010, directed to GB Patent Application No. 1010955.1; 2 pages.

International Search Report and Written Opinion mailed Sep. 15, 2011, directed to International Application No. PCT/GB2011/051129; 14 pages.

*Primary Examiner* — Dung Van Nguyen
(74) *Attorney, Agent, or Firm* — Morrison & Foerster LLP

(57) ABSTRACT

A surface treating appliance includes a plurality of frusto-conical cyclones arranged in parallel. Each cyclone has a relatively wide, rigid frusto-conical portion and a relatively narrow, flexible frusto-conical portion connected to the relatively wide portion. The relatively wide portion includes at least one dirty air inlet, and the relatively narrow portion includes a dirt outlet. The relatively narrow portion vibrates during use of the appliance is dislodged dirt from the inner surface of the relatively narrow portion, the dislodged dirt being expelled from the dirt outlet.

16 Claims, 22 Drawing Sheets

B - B

SURFACE TREATING APPLIANCE

REFERENCE TO RELATED APPLICATIONS

This application claims the priority of United Kingdom Application No. 1010955.1, filed Jun. 30, 2010, the entire contents of which are incorporated herein by reference.

FIELD OF THE INVENTION

This invention relates to a surface treating appliance and in particular to a vacuum cleaner comprising at least one cyclone.

BACKGROUND OF THE INVENTION

Surface treating appliances, for example vacuum cleaners can separate dirt and dust from an airflow without the use of a filter bag. These so-called bagless vacuum cleaners are very popular. Most bagless vacuum cleaners use cyclonic or centrifugal separation to spin dirt and dust from the airflow. By avoiding the use of a filter bag as the primary form of separation, it has been found to be possible to maintain a consistently high level of suction, even as the collecting chamber fills with dirt.

The principle of cyclonic separation in domestic vacuum cleaners is described in a number of publications including EP 0 042 723. In general, an airflow in which dirt and dust is entrained enters a first cyclonic separator via a tangential inlet which causes the airflow to follow a spiral or helical path within a collection chamber so that the dirt and dust is separated from the airflow. Relatively clean air passes out of the chamber while the separated dirt and dust is collected therein. In some applications, the airflow is then passed through a second and possibly a third stage of cyclonic separation which is capable of separating finer dirt and dust than the upstream cyclone. The airflow is thereby cleaned to a greater degree so that, by the time the airflow exits the cyclonic separating apparatus, the airflow is almost completely free of dirt and dust particles.

Small cyclones can be desirable as they may be able to separate smaller particles of dust. In particular it has been found that small tip (dirt outlet) diameters on cyclones can increase separation efficiency. However, it has also been found that as the cyclones decrease in size there is an increased risk of them blocking, which would impact of the overall separation efficiency of the surface treating appliance.

SUMMARY OF THE INVENTION

A first aspect of the present invention provides a surface treating appliance or cyclonic separating apparatus comprising at least one cyclone wherein at least a portion of at least one cyclone is flexible. Advantageously, having a flexible portion may help to prevent dirt from building up inside the cyclone during use of the surface treating appliance.

In one embodiment the entire cyclone is flexible. In another embodiment the cyclone comprises a rigid portion and a flexible portion. Preferably the flexible portion includes at least a flexible tip of the cyclone.

The cyclone may comprise at least one dirty air inlet. The dirty air inlet may be provided on a flexible portion of the cyclone. Alternatively the dirty air inlet may be provided on a rigid portion of the cyclone. The dirty air inlet may be formed as an integral inlet portion of the cyclone.

The cyclone may comprise a dirt outlet. The dirt outlet may be provided in a flexible portion, and in particular at an end of a flexible tip of the at least one cyclone. For example, the at least one dirty air inlet may be located in a rigid portion of the cyclone, and the dirt outlet may be located in a flexible portion of the cyclone.

The cyclone may be frusto-conical in shape. In this case, the cyclone may have a relatively wide, rigid portion comprising the at least one dirty air inlet, and a relatively narrow, flexible portion comprising the dirt outlet so that only the portion of the cyclone comprising the dirt outlet vibrates during use of the cyclone. Forming the at least one dirty air inlet in a rigid portion of the cyclone can enable the size of the at least one dirty inlet to be maintained in a stationary position during use of the cyclone, and can enable the size of the at least one dirty air inlet to be maintained constant during use of the cyclone.

The cyclone may be a reverse flow cyclone.

As used herein the term "flexible" shall be taken to mean that the portion of the at least one cyclone which is flexible will be deflected more than 1 mm when subjected to the test conditions described in Test 1 or Test 2 in the specific description and shown in FIGS. 13*a* to 13*c*. As an example, the flexible portion may have a Shore A value of up to 80 Shore A, for example the flexible portion may have a Shore A value of from 20, or 25, or 30, or 35 to 40 or 45, or 50, or 55, or 60. The entire cyclone or a flexible portion of the cyclone may be formed from an elastomer, for example a plastics material, or rubber. The entire cyclone or a flexible portion of the cyclone may be formed, for example, from a thermoplastic elastomer, TPU, silicon rubber or natural rubber.

As used herein the term "rigid" shall be taken to mean that the portion of the at least one cyclone which is rigid will be deflected less than 1 mm when subjected to the test conditions described in Test 1 or Test 2 in the specific description and as shown in FIGS. 13*a* to 13*c*. As an example, the rigid portion may have a Shore D value of above 60 Shore D, for example the rigid portion may have a Shore D value of from 60, or 65, or 70, to 75, or 80, or 85 or 90. The rigid portion may be formed from a plastics or metal material, for example poly propylene, ABS or aluminium.

As used herein the term "tip" shall be taken to mean an end portion of the at least one cyclone. In a preferred embodiment the tip may be a lower end portion of the at least one cyclone. The tip may comprise up to 95% of the total length of the cyclone but more preferably the tip may be 50% or less than the total length of the at least one cyclone. For example the tip may be from 5, or 10, or 15, or 20 to 25, or 30, or 35, or 40% of the total length of the at least one cyclone. In a preferred embodiment the tip may have a wall thickness of from 0.2, or 0.5 to 1 or 1.5 mm. Part of the flexible portion of the at least one cyclone may comprise the tip. Alternatively, the tip may form the flexible portion of the at least one cyclone.

In a particular embodiment where the cyclone comprises a rigid portion and a flexible portion, the flexible portion may be over-molded on to the rigid portion of the at least one cyclone. Additionally or alternatively the flexible portion may be glued, fixed or clamped to the rigid portion by any suitable method or by using any suitable fixing means. The flexible portion is preferably attached to the rigid portion in an airtight manner. The flexible portion may be fixed to the rigid portion such that there is a step, either internal or external, between the flexible portion and the rigid portion. Preferably the inner surface of the at least one cyclone is smooth or otherwise such that there is no step between the rigid portion and the flexible portion.

The at least one cyclone may be from 5 mm to 400 mm in length, for example the at least one cyclone may be from 10, or 20, or 30, or 40, or 50, or 60 or 70, to 100, or 200, or 300, or 400 mm in length. The dirt outlet may have a diameter of from 0.2 to 20 mm, for example the dirt outlet may have a diameter of from, 0.2, or 0.4, or 0.5, or 0.6, or 0.8 to 1, or 1.5, or 2, or 5, or 10 mm. The dirt outlet may be chamfered. In an embodiment where the dirt outlet is chamfered the dirt outlet diameter may be measured as the diameter at the uppermost point of the dirt outlet.

At least a portion of the at least one cyclone may be arranged to vibrate as airflow moves through the surface treating apparatus during use. Constructing a flexible portion from a material having a Shore A value of from 20 to 60 has been found to result in a flexible portion which vibrates as airflow moves through the surface treating apparatus during use. In particular the dirt outlet in the flexible portion has been found to vibrate.

In a particularly preferred embodiment where a flexible tip was formed using material having a Shore A hardness of 20 and having a dirt outlet diameter of 0.5 mm, the flexible tips were found to vibrate at around 500 Hz, at an amplitude of approx 0.05 mm. This had the effect of breaking off dust deposits before they could load up and block the flexible tip of the cyclone. This frequency and amplitude of vibration was achieved by the airflow through the cyclone exciting the dirt outlet at its natural frequency. Thus using such a cyclone advantageously may mean that smaller cyclones, that previously would have been liable to blockage, may now be used. Being able to utilize smaller cyclones may therefore also advantageously increase the overall separation efficiency of the surface treating appliance.

The surface treating apparatus may further comprise means for dilating, inflating, deforming, compressing and/or moving a flexible portion of the at least one cyclone, and so in a second aspect the present invention provides a surface treating appliance or cyclonic separating apparatus comprising a cyclone having a flexible portion, and means for dilating, inflating, deforming, compressing and/or moving the flexible portion.

A flexible portion of the at least one cyclone, for example the flexible tip, may be dilatable such that it can be dilated and/or relaxed in order to change its shape and or dimensions. The flexible portion may be arranged such that in its relaxed state the dirt outlet has a smaller diameter than when it is in its dilated state. In this way during use of the surface treating appliance the flexible portion is relaxed such that it has a small diameter dirt outlet, thus increasing the separation efficiency of the cyclone. Then, after use, the flexible portion can be dilated to increase the diameter of the dirt outlet to help dislodge any dirt which may have built up in the flexible portion during use.

A flexible portion of the at least one cyclone, for example the flexible tip, may be inflatable such that it can be partially or totally filed with a fluid in order to change its shape and/or dimensions. The flexible portion may be arranged such that in its inflated state the dirt outlet has a smaller diameter than when it is in its deflated state. In this way during use of the surface treating appliance the flexible portion can be inflated such that it has a small diameter dirt outlet, thus increasing the separation efficiency of the cyclone. Then, after use, the flexible portion can be deflated to increase the diameter of the dirt outlet to help dislodge any dirt which may have built up in the flexible portion during use.

Additionally or alternatively the cyclonic separating apparatus may further comprise a device for manually, or mechanically, moving or compressing a flexible portion of the cyclone. For example, the device may comprise a paddle, pad, arm or rod which may be arranged to hit against, compress or move a flexible portion of the cyclone, for example the flexible tip, in order to try to help dislodge any dirt which may have become trapped in the flexible portion during use of the surface treating appliance.

In a preferred embodiment the surface treating appliance comprises a plurality of cyclones, wherein at least a portion of one cyclone, but preferably at least a portion of each of the cyclones, may be flexible. The plurality of cyclones may be arranged in parallel in terms of airflow through the cyclones.

In a third aspect the present invention provides a surface treating appliance or cyclonic separating apparatus comprising a plurality of frusto-conical cyclones arranged in parallel and each having a relatively wide, rigid frusto-conical portion and a relatively narrow, flexible frusto-conical portion connected to the relatively wide portion, the relatively wide portion comprising at least one dirty air inlet and the relatively narrow portion comprising a dirt outlet.

The plurality of cyclones may also be arranged such that they are physically in parallel with each other. For example, the cyclones may be arranged about an axis, with the cyclones being equally spaced from the axis and, preferably equally spaced about, the axis.

Alternatively one or more cyclones may be arranged as a stack, either in single rows or in groups. For example, the plurality of cyclone may comprise a first set of cyclones arranged in a first arrangement about the axis, and a second set of cyclones arranged in a second arrangement about the axis and spaced along the axis from the first set.

The surface treating appliance may further comprise one or more rigid cyclones arranged either upstream or downstream of the cyclone(s). The rigid cyclone(s) may be arranged in parallel or in series in terms of airflow through the rigid cyclone(s).

In a particular embodiment the plurality of cyclones may form at least a part of a filter cartridge which may be removable from the remainder of the surface treating appliance. This may advantageously allow the filter cartridge to be more easily cleaned and/or replaced if desired.

The plurality of cyclones may be orientated such that their longitudinal axes are vertical or substantially vertical. In a preferred embodiment their longitudinal axes may be substantially parallel or parallel, and preferably parallel to said axis about which the cyclones are arranged.

In an alternative embodiment the cyclones may be arranged in an annular arrangement with their dirt outlets pointing substantially inwardly. The cyclones may be orientated such that their longitudinal axes are horizontal or substantially horizontal. Alternatively the cyclones may be orientated such that their longitudinal axes are inclined to said axis about which the cyclones are arranged.

In embodiments where there is a rigid portion and a flexible tip or portion, one or more of the flexible tips or portions may be bent, curved or shaped away from the longitudinal axis of the rigid portion.

Two or more layers or sets of cyclones may be stacked to form a column of cyclones arranged with a parallel airflow path through each of the cyclones.

The cyclones preferably form part of a cyclonic separating apparatus comprising a first cyclonic cleaning stage and a second cyclonic cleaning stage located downstream from the first cyclonic cleaning stage and comprising the plurality of cyclones.

The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines, pressure washing machines, ground marking machines and shampooing machines. It also includes lawn mowers and other cutting machines. In a preferred embodiment the surface treating appliance is a vacuum cleaner.

Features described above in connection with the first aspect of the invention are equally applicable to each of the second and third aspects of the invention, and vice versa.

BRIEF DESCRIPTION OF THE DRAWINGS

The invention will now be described, by way of example, with reference to the accompanying drawings, in which.

DETAILED DESCRIPTION OF THE INVENTION

Figure 1:
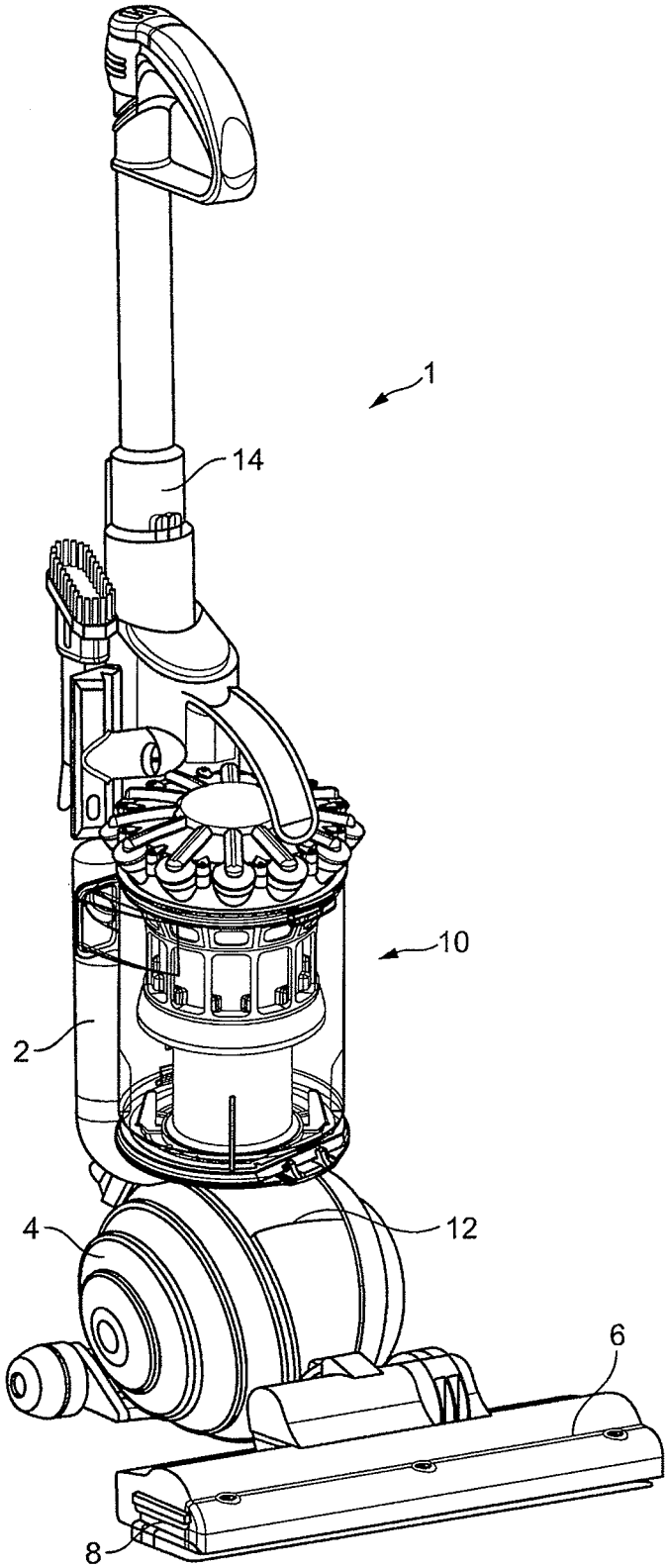
FIG. 1 shows a perspective view of an upright vacuum cleaner.

Like reference numerals refer to like parts throughout the specification.

FIG. 1 illustrates a surface treating appliance, which in this example is a vacuum cleaner 1. The vacuum cleaner 1 comprises a main body 2 and a rolling support structure 4 mounted on the main body 2 for maneuvering the vacuum cleaner 1 across a surface to be cleaned. A cleaner head 6 is pivotably mounted on the lower end of the rolling support structure 4 and a dirty air inlet 8 is provided on the underside of the cleaner head 6 facing the surface to be cleaned. A separating apparatus 10 is removably provided on the main body 2 and ducting 12 provides communication between the dirty air inlet 8 and the separating apparatus 10. A wand and handle assembly 14 is mounted on the main body 2 behind the separating apparatus 10.

In use, a motor and fan unit (not shown) which is located inside the rolling support structure 4 draws dust laden air into the vacuum cleaner 1 via either the dirty air inlet 8 or the wand 14. The dust laden air is carried to the separating apparatus 10 via the ducting 12 and the entrained dust particles are separated from the air and retained in the separating apparatus 10. The cleaned air passes through the motor and is then ejected from the vacuum cleaner 1.

Figure 2:
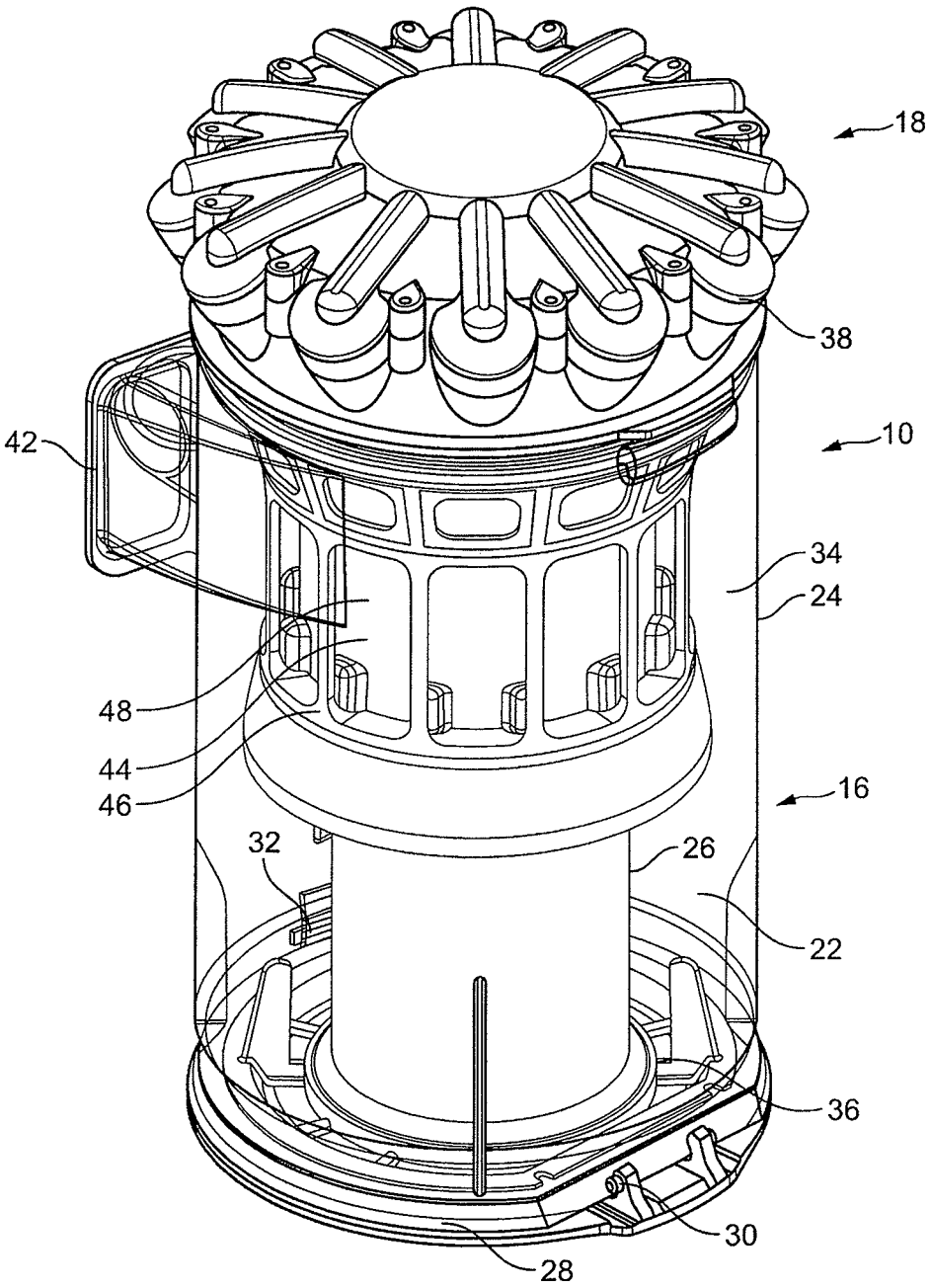
FIG. 2 shows a perspective view of cyclonic separating apparatus of the vacuum cleaner shown in FIG. 1.

The separating apparatus 10 forming part of the vacuum cleaner 1 is shown generally in FIG. 2. The specific overall shape of the separating apparatus 10 can be varied according to the type of vacuum cleaner 1 in which the separating apparatus 10 is to be used. For example, the overall length of the separating apparatus 10 can be increased or decreased with respect to the diameter of the separating apparatus 10.

The separating apparatus 10 comprises a first cyclonic cleaning stage 16 and a second cyclonic cleaning stage 18. In some embodiments the separating apparatus 10 also comprises a pre motor filter 20 located longitudinally through the separating apparatus 10.

The first cyclonic cleaning stage 16 comprises an annular chamber 22 located between the outer wall 24 of the separating apparatus 10, which wall 24 is substantially cylindrical in shape, and a second cylindrical wall 26 which is located radially inwardly of and spaced from the outer wall 24. The lower end of the first cyclonic cleaning stage 16 is closed by a base 28 which is pivotably attached to the outer wall 24 by means of a pivot 30 and held in a closed position by a catch 32. In the closed position, the base 28 is sealed against the lower ends of the walls 24, 26. Releasing the catch 32 allows the base 28 to pivot away from the outer wall 24 and the second cylindrical wall 26 for emptying of the first cyclonic cleaning stage 16 and the second cyclonic cleaning stage 18.

The top portion of the annular chamber 22 forms a cylindrical cyclone 34 of the first cyclonic cleaning stage 16 and the lower portion of the annular chamber 22 forms a dust collecting bin 36. The second cyclonic cleaning stage 18 comprises twelve secondary cyclones 38, which are arranged in parallel in terms of airflow through the cyclones 38, and a second dust collecting chamber 40.

A dust laden air inlet 42 is provided in the outer wall 24. The dust laden air inlet 42 is arranged tangentially to the outer wall 24 so as to ensure that incoming dust laden air is forced to follow a helical path around the annular chamber 22. A fluid outlet from the first cyclonic cleaning stage 20 is provided in the form of a mesh shroud 44. The mesh shroud 44 comprises a cylindrical wall 46 in which a large number of perforations 48 are formed. The only fluid outlet from the first cyclonic cleaning stage 16 is formed by the perforations 48 in the shroud 44.

Figure 3:
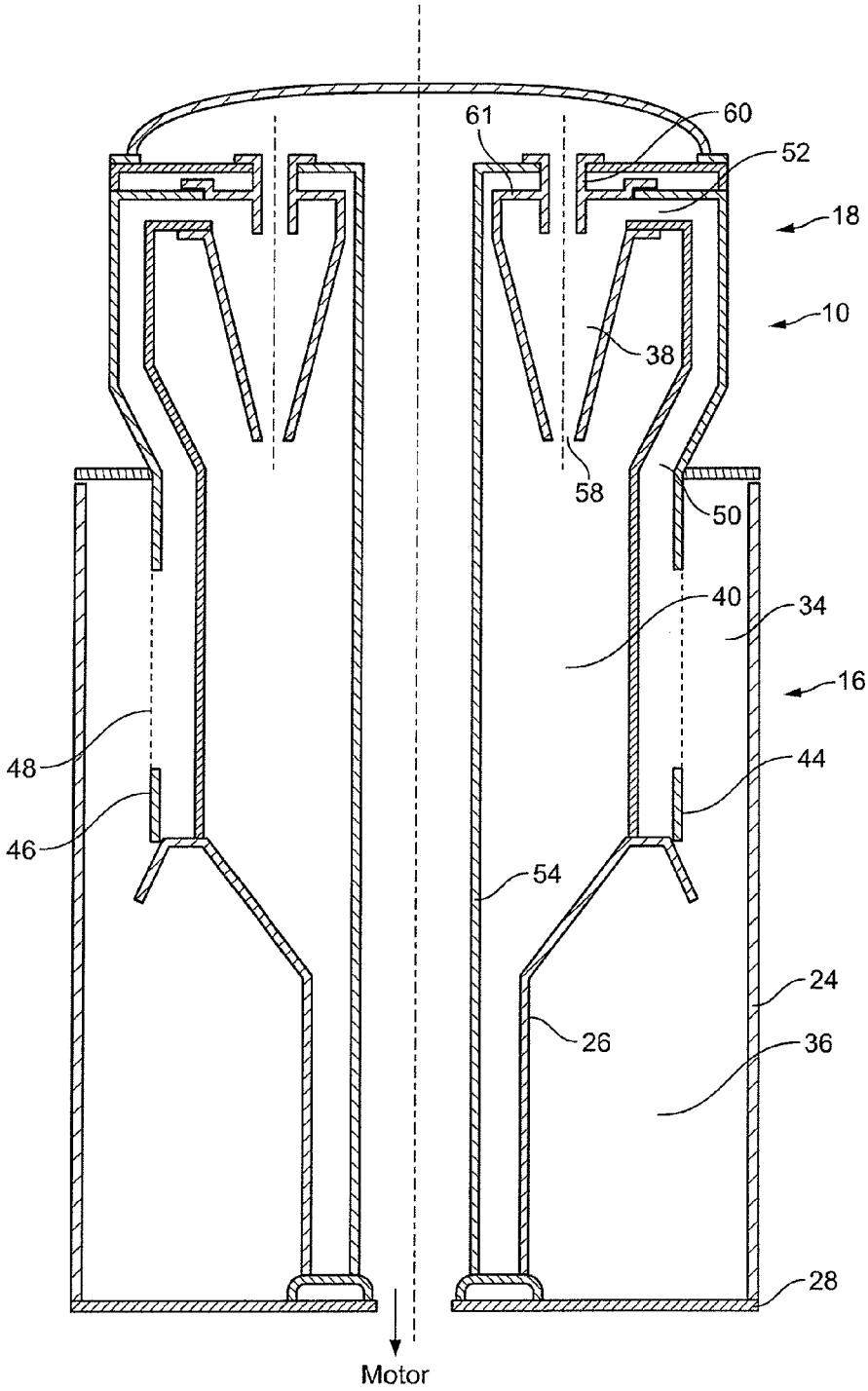
FIG. 3 shows a section through a first embodiment of a cyclonic separating apparatus, where a cyclone is made entirely from a flexible material.

FIG. 3 illustrates a section through a first embodiment of the cyclonic separating apparatus 10. A passageway 50 is formed downstream of the shroud 44. The passageway 50 communicates with the second cyclonic cleaning stage 18. The passageway 50 may be in the form of an annular chamber which leads to inlets 52 of the secondary cyclones 38 or may be in the form of a plurality of distinct air passageways each of which leads to a separate secondary cyclone 38.

A third cylindrical wall 54 extends downwardly towards the base 28. The third cylindrical wall 54 is located radially inwardly of, and is spaced from, the second cylindrical wall 26 so as to form the second dust collecting chamber 40. When the base 28 is in the closed position, the third cylindrical wall 54 is sealed against the base 28.

The secondary cyclones 38 are arranged substantially or totally above the first cyclonic cleaning stage 16. The secondary cyclones 38 are arranged in an annular arrangement which is centered on the axis of the first cyclonic cleaning stage 16. In this embodiment, each secondary cyclone 38 has an axis which is generally parallel to the axis of the first cyclonic cleaning stage.

Each secondary cyclone 38 is generally frusto-conical in shape. The relatively narrow portion of each secondary cyclone 38 comprises a dirt outlet 58 which opens into the top of the second dust collecting chamber 40. In use dust separated by the secondary cyclones 38 will exit through the dirt outlets 58 and will be collected in the second dust collecting chamber 40. A vortex finder 60 is provided at a relatively wide, upper end of each secondary cyclone 38 to provide an air outlet from the secondary cyclone 38. Where provided, the vortex finders 60 communicate with the pre motor filter 20. Each vortex finder 60 extends through a generally annular top wall 61 of the secondary cyclone 38.

In the embodiment shown in FIG. 3 the secondary cyclones 38 are made entirely of a flexible material, for example rubber, so that the secondary cyclones 38 are deformable. The flexible material is preferably rubber, which in this embodiment has a Shore A value of 22. During use of the vacuum cleaner 1, the secondary cyclones 38 vibrate as airflow passes through them. This vibration has been found to help prevent a build up of dirt within the secondary cyclones 38. The second dust collecting chamber 40 is ideally separated from atmospheric pressure to prevent the secondary cyclones 38 from collapsing.

Each secondary cyclone 38 has a secondary cyclone dirty air inlet 52 which may be formed from the same material as the remainder of the secondary cyclones 38. In addition, the vortex finders 60 and the top wall 61 of the secondary cyclones 38 may also be formed from a flexible material.

Figure 4A:
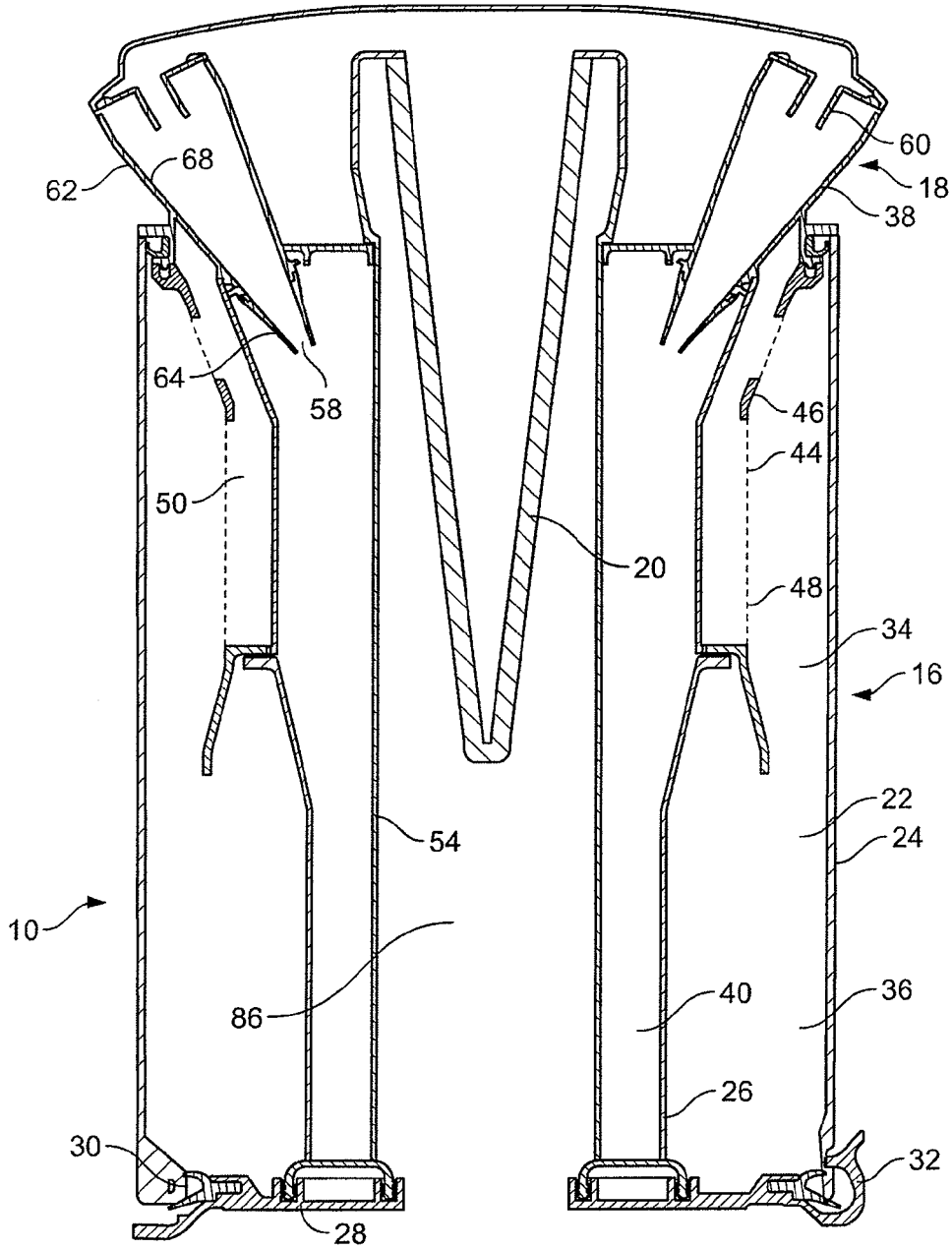
FIG. 4*a* shows a section through a second embodiment of a cyclonic separating apparatus, where a cyclone has a rigid portion and a flexible tip.

FIG. 4*a* illustrates a second embodiment of the cyclonic separating apparatus 10. In this second embodiment, each secondary cyclone 38 has a rigid upper portion 62 and a flexible lower portion, comprising a flexible tip 64. The flexible material from which the flexible tips are formed is preferably rubber with a Shore A value of 20. The rigid material is preferably polypropylene with a Shore D value of 60.

Figure 4B:
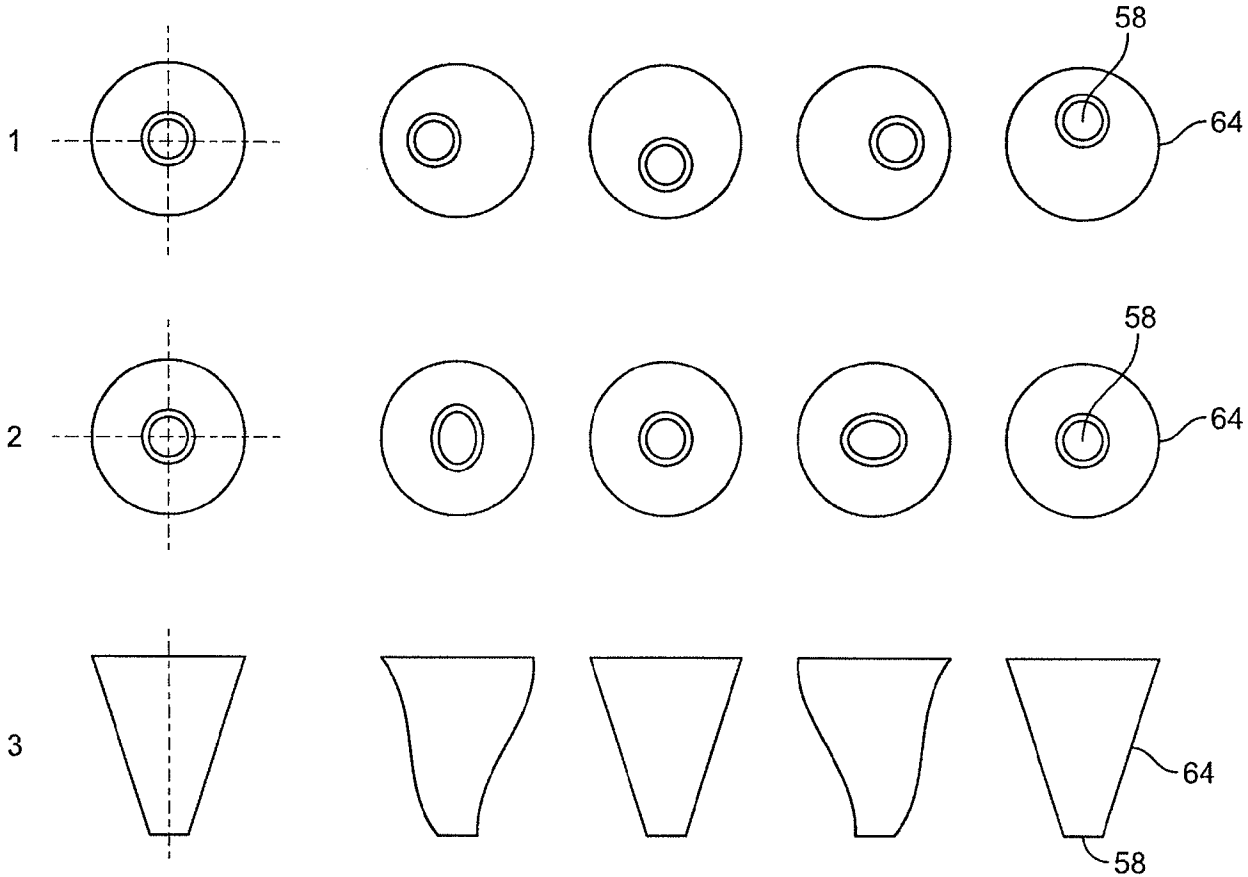
FIG. 4*b* shows schematic views of the flexible tips in (i) rotation, (ii) compression and (iii) side to side movement.

It has been found that the flexible tips 64 vibrate as airflow passes through the secondary cyclones 38 during use of the vacuum cleaner 1. This vibration has been found to help prevent a build up of dirt within the secondary cyclones 38. FIG. 4*b* illustrates (i) rotation, (ii) compression and (iii) side to side movements as examples of the types of vibration which have been found to occur in the flexible tips 64 as airflow passes through the secondary cyclones 38.

As shown in FIG. 4*a*, the flexible tips 64 are preferably less than one third of the total length of the secondary cyclones 38. The secondary cyclones 38 are 65.5 mm in length and have a dirt outlet diameter of 3.3 mm. The flexible tips 64 are 15 mm in length. The flexible tips 64 are over-molded on to the rigid portions 62 such that the inner surfaces 68 of the secondary cyclones 38 are smooth. In this embodiment, the secondary cyclones 38 are arranged so that the axes of the second cyclones 38 are inclined inwardly relative to, and towards, the longitudinal axis of the first cyclonic cleaning stage 16.

With reference now to FIGS. 5 to 9, the vacuum cleaner 1 may also further comprise means for dilating, inflating, deforming, compressing and/or moving the flexible tips 64 of the secondary cyclones 38. FIGS. 5 to 8 show embodiments where the flexible tips 64 are dilatable or inflatable by different methods. FIG. 9 shows an embodiment where the vacuum cleaner 1 has a device for contacting, flicking or knocking the flexible tips 64.

Figure 5A:
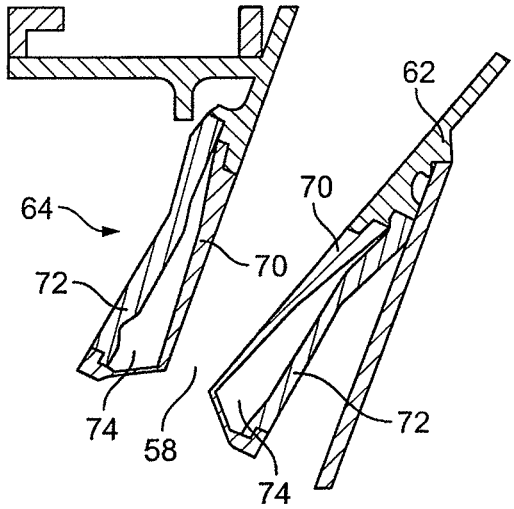
FIG. 5*a* shows a close up section through a cyclone of a third embodiment of a cyclonic separating apparatus, the cyclone having a rigid portion and a dilatable flexible tip, the flexible tip being shown in its relaxed state.
Figure 5B:
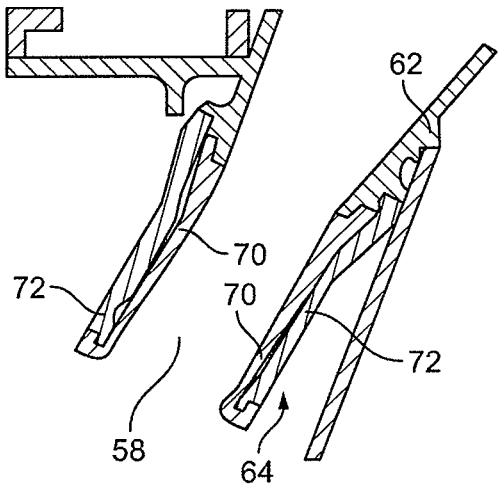
FIG. 5*b* shows the cyclone shown in FIG. 5*a* where the flexible tip is in its dilated state.

FIGS. 5*a* and 5*b* illustrate a dilatable flexible tip 64. The flexible tip 64 comprises an inner wall 70 and an outer wall 72 which may be integrally formed or joined to form a tip chamber 74 therebetween. FIG. 5*a* shows the flexible tip 64 in its relaxed state and FIG. 5*b* shows the flexible tip 64 in its dilated state. The flexible tips 64 may move between their relaxed and dilated states in response to pressure changes within the cyclonic separating apparatus 10. The flexible tip 64 is over-molded onto a rigid portion 62 of the secondary cyclone 38. The dirt outlet 58 is largest when the flexible tip 64 is in its dilated state, as shown in FIG. 5*b*.

In an alternative embodiment the tip chambers 74 may be inflated and deflated by passing a fluid into and out of the tip chambers 74.

The preferred mode of operation is that the flexible tips 64 are relaxed so that the dirt outlet 58 is at its smallest diameter during use of the vacuum cleaner 1. When the vacuum cleaner 1 is switched off, the flexible tips 64 dilate to release dirt trapped in the secondary cyclones 38, for example into the second dust collecting chamber 40.

Figure 6A:
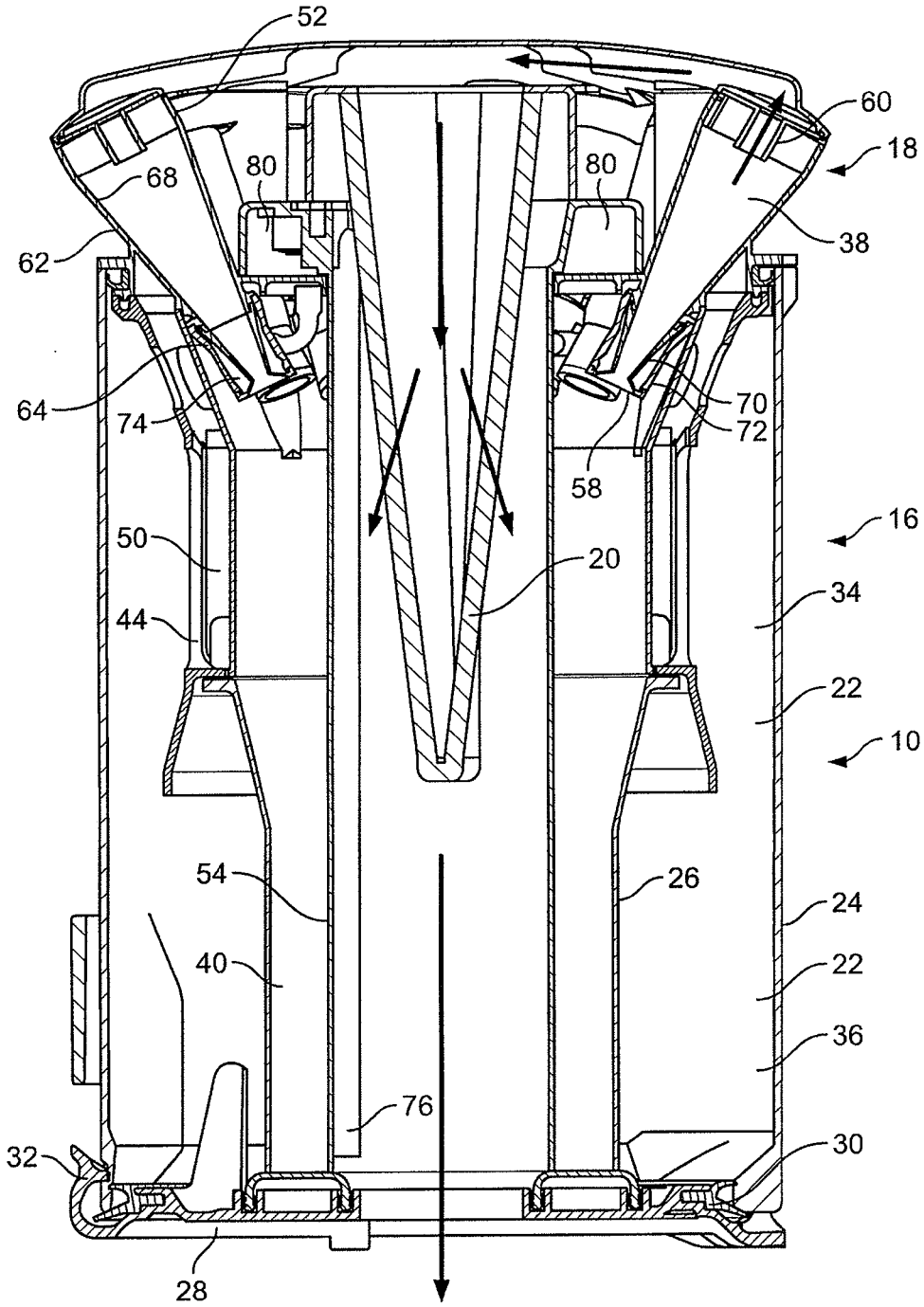
FIGS. 6*a* to 6*d* show sections through a fourth embodiment of a cyclonic separating apparatus, showing a one way ball valve for controlling dilation of the flexible tips of the cyclones, the flexible tips being shown in their relaxed state.
Figure 6B:
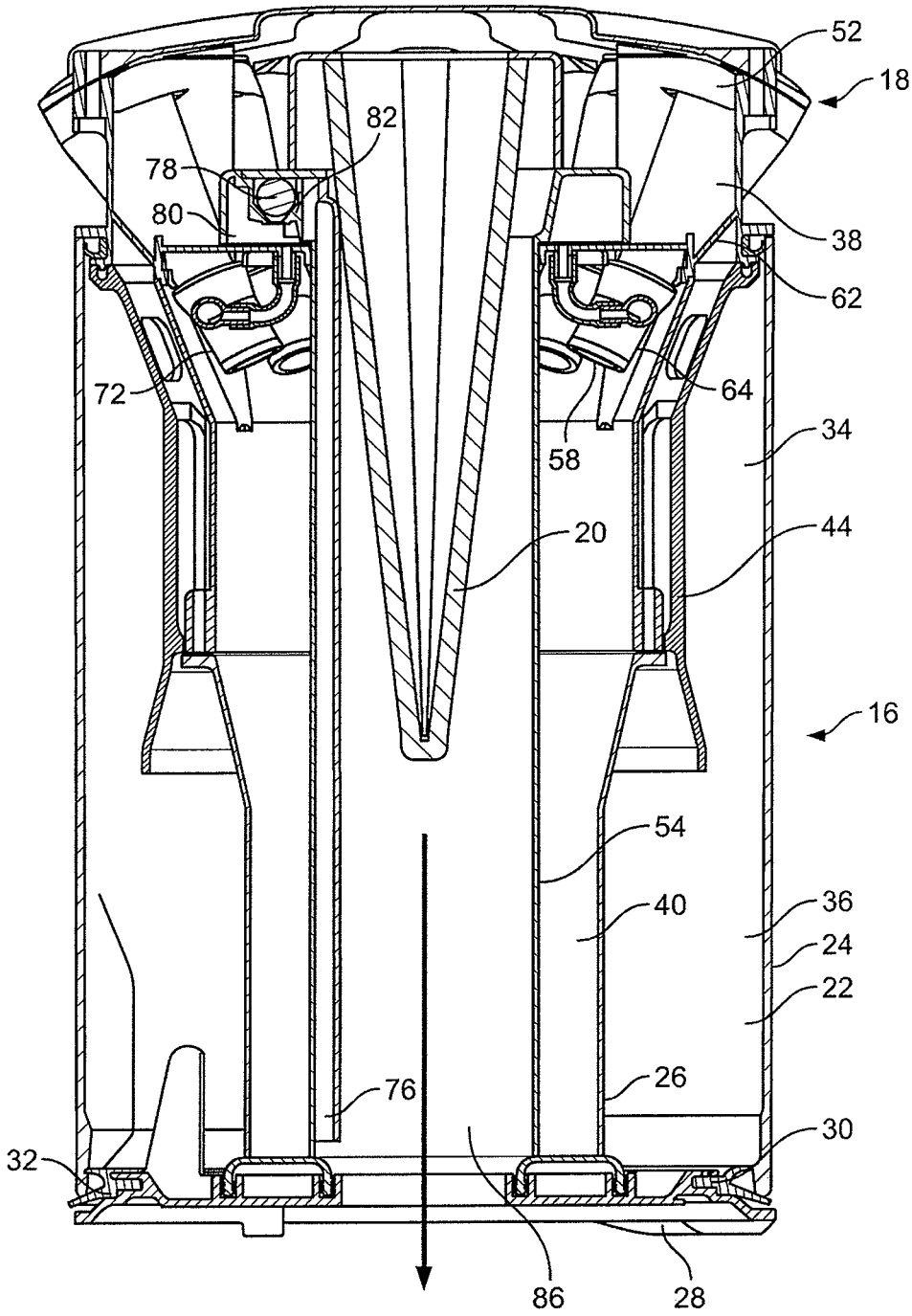
Figure 6C:
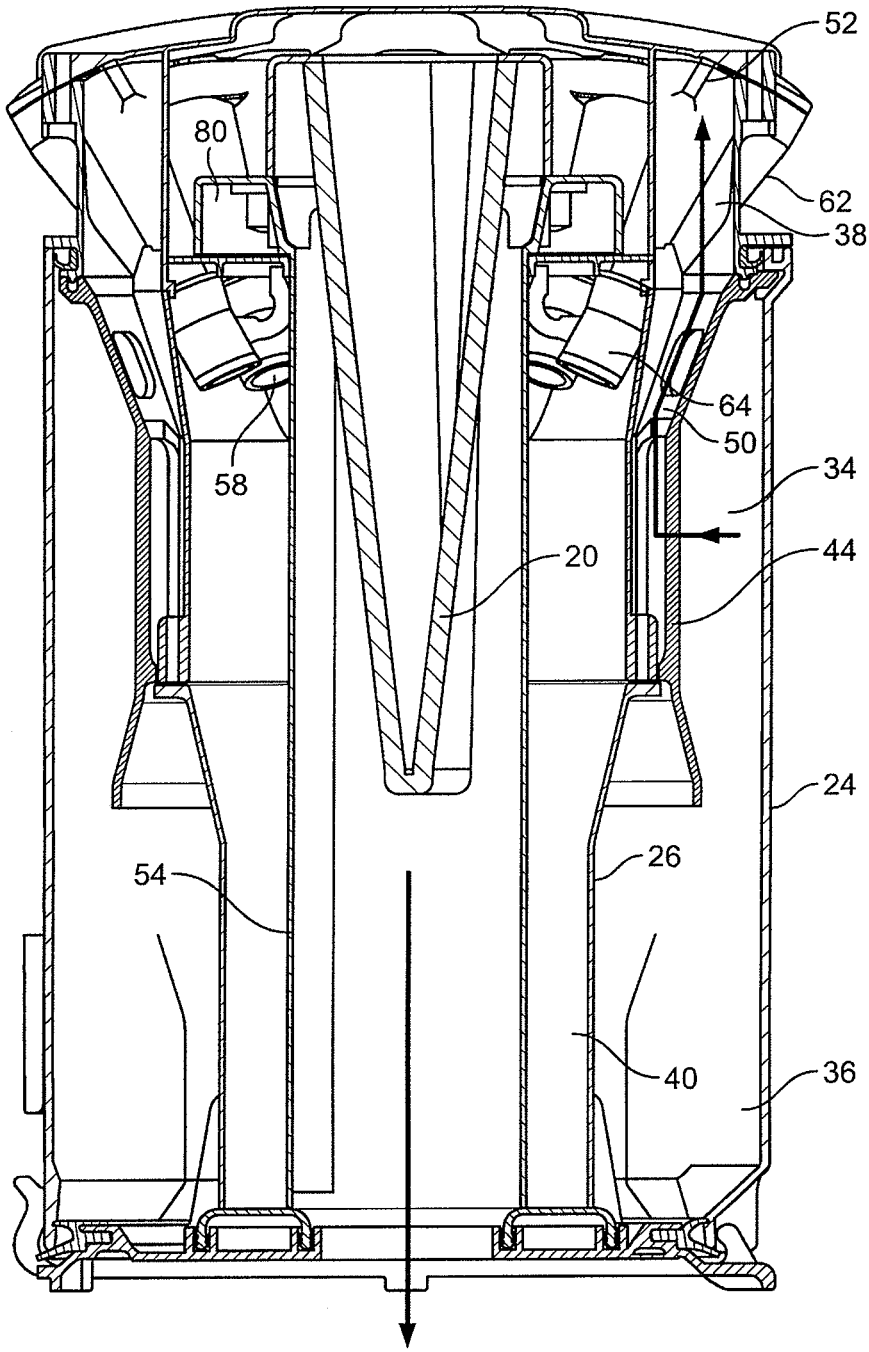
Figure 6D:
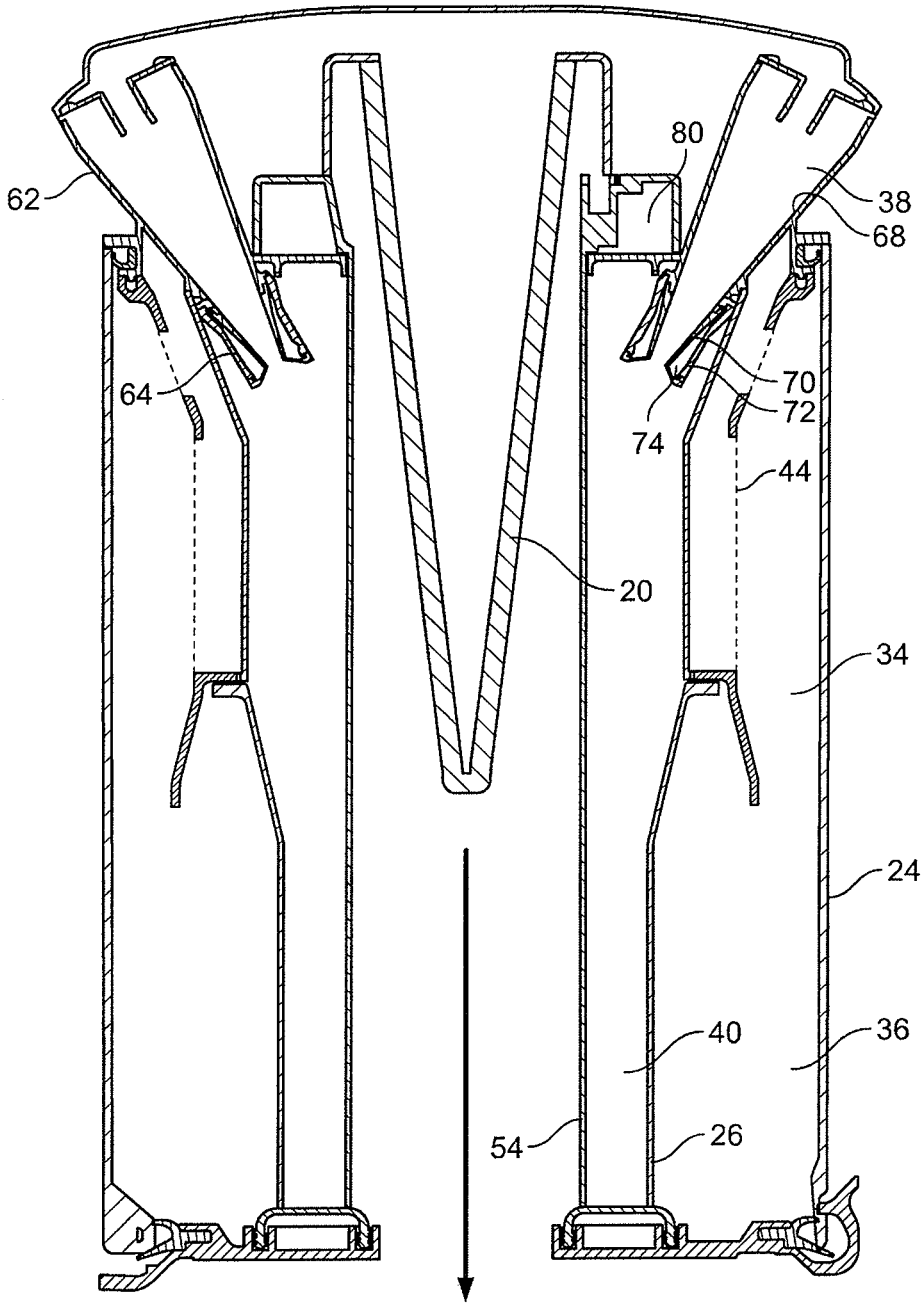
Figure 6E:
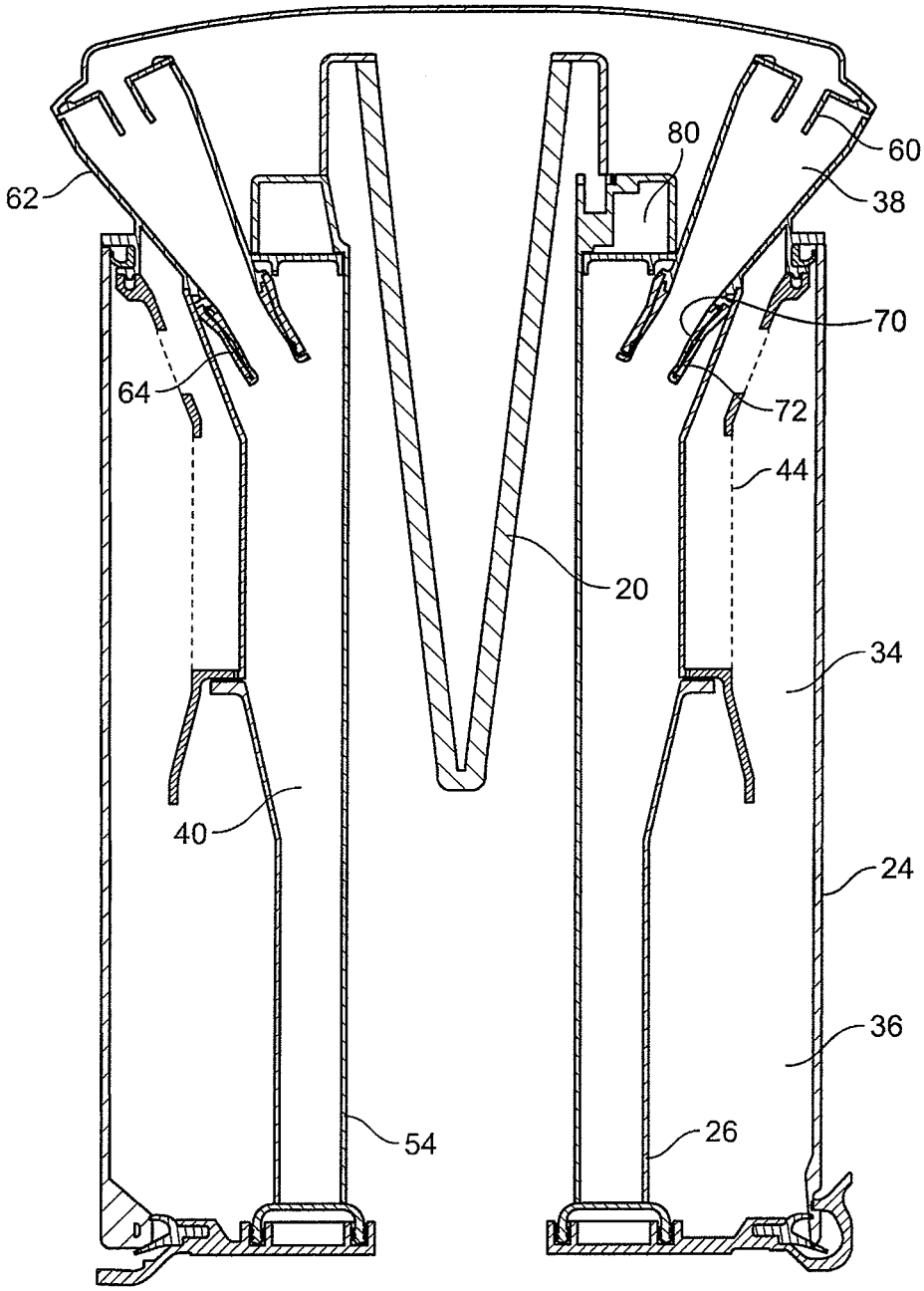
FIG. 6*e* shows a section through this cyclonic separating apparatus showing the flexible tips in their dilated state.

In the embodiment shown in FIGS. 6*a* to 6*e* the normal operating conditions of the vacuum cleaner 1, where the flexible tips 64 are in their relaxed state, are shown in FIGS. 6*a* to 6*d*. Airflow through the cyclonic separating apparatus 10 is indicated by the arrows shown in FIGS. 6*a* and 6*c*. FIG. 6*c* shows the airflow from the first cyclonic cleaning stage 16 passing through the shroud 44, along the passageway 50 and into the inlets 52 of the secondary cyclones 38. FIG. 6*a* shows the airflow from the secondary cyclones 38 passing through the pre motor filter 20 towards the motor and fan assembly. The off condition of the vacuum cleaner 1, where the flexible tips 64 are in their dilated position, is shown in FIG. 6*e*.

During normal operation of the vacuum cleaner 1 (i.e. in FIGS. 6*a* to 6*d*) the second dust collecting chamber 40 will be at around 9 kPa below atmospheric pressure. There will be a similar pressure inside the secondary cyclones 38. In order to prevent the flexible tips 64 from inflating and blocking the dirt outlets 58, the pressure in the tip chambers 74 has to be equalized with the pressure inside the second dust collecting chamber 40 and the pressure inside the secondary cyclones 38. This is achieved by connecting the tip chambers 74 to a similarly low pressure. Thus each tip chamber 74 is fluidly connected to a pressure tap 76 which is located downstream of the pre motor filter 20.

Locating the pressure tap 76 downstream of the pre motor filter 20 is advantageous because the air in this area is clean and will therefore reduce ingress of dust into the pressure tap 76 and thus into the tip chambers 74. It is also advantageous because the pressure available at the eye of the motor can achieve a maximum pressure difference to atmosphere, and give the largest dilation of the flexible tips 64. Certainly the pressure at this point is always lower than the pressure inside the second dust collecting chamber 40 and so inflation of the flexible tips 64 will not occur.

During normal operation of the vacuum cleaner 1 the pressure at the pressure tap 76 is normally around 1.5 kPa (which is equal to the pressure drop across the pre motor filter 20). This has the effect of applying a very slight dilation force to the flexible tips 84, but not enough to significantly deform them.

Each tip chambers 74 is linked to a pressure tap 76 via a one way ball valve 78 in a large reservoir chamber 80. This reservoir chamber 80 is required to sustain a low pressure difference long enough to dilate the flexible tips 64 at around 10 kpa. Thus when the vacuum cleaner 1 is switched off, the pressure in the secondary cyclones 38 and the second dust collecting chamber 40 returns to atmospheric pressure. The tip chambers 74 however remain at below atmospheric pressure because of the one way ball valve 78. This means that when the vacuum cleaner 1 is switched off atmospheric pressure pushes the inner wall 70 of the flexible tip 64 towards the outer wall 72 of the flexible tip 64, causing the dirt outlet 58 to dilate as shown in FIG. 6*e*.

The seat 82 of the ball valve 78 is scored to allow a controlled leak of air back into the reservoir chamber 80 and tip chamber 74 to allow the flexible tips 64 to relax back into their relaxed position within a few seconds. This mechanism allows the flexible tips 64 to dilate and then quickly relax again each time the vacuum cleaner 1 is switched off, thereby helping to keep the secondary cyclones 38 free of trapped dirt.

Figure 7A:
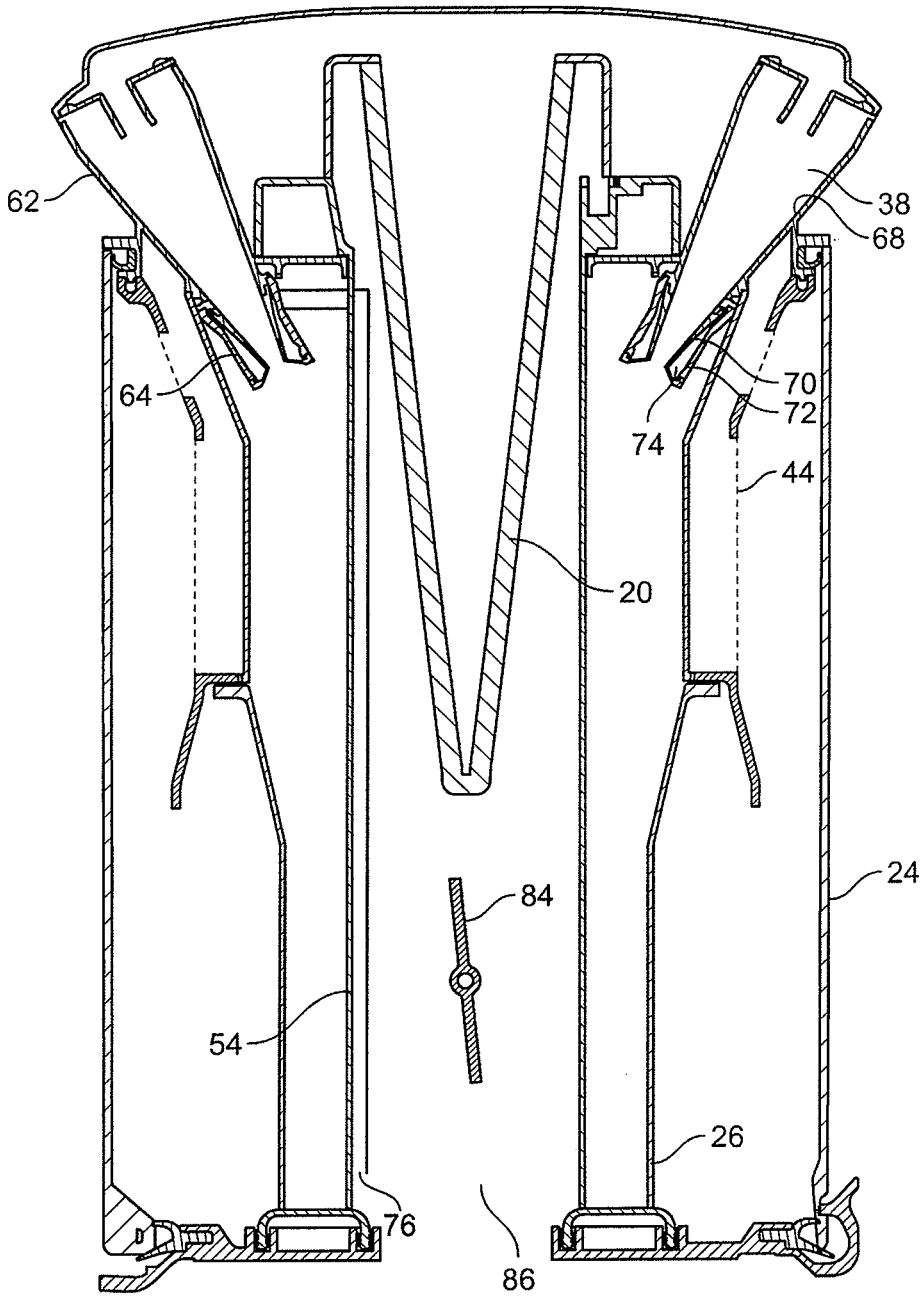
FIG. 7*a* shows a section through a fifth embodiment of a cyclonic separating apparatus, showing a control valve for controlling dilation of the flexible portion of the cyclones, the flexible tips being shown in their relaxed state.
Figure 7B:
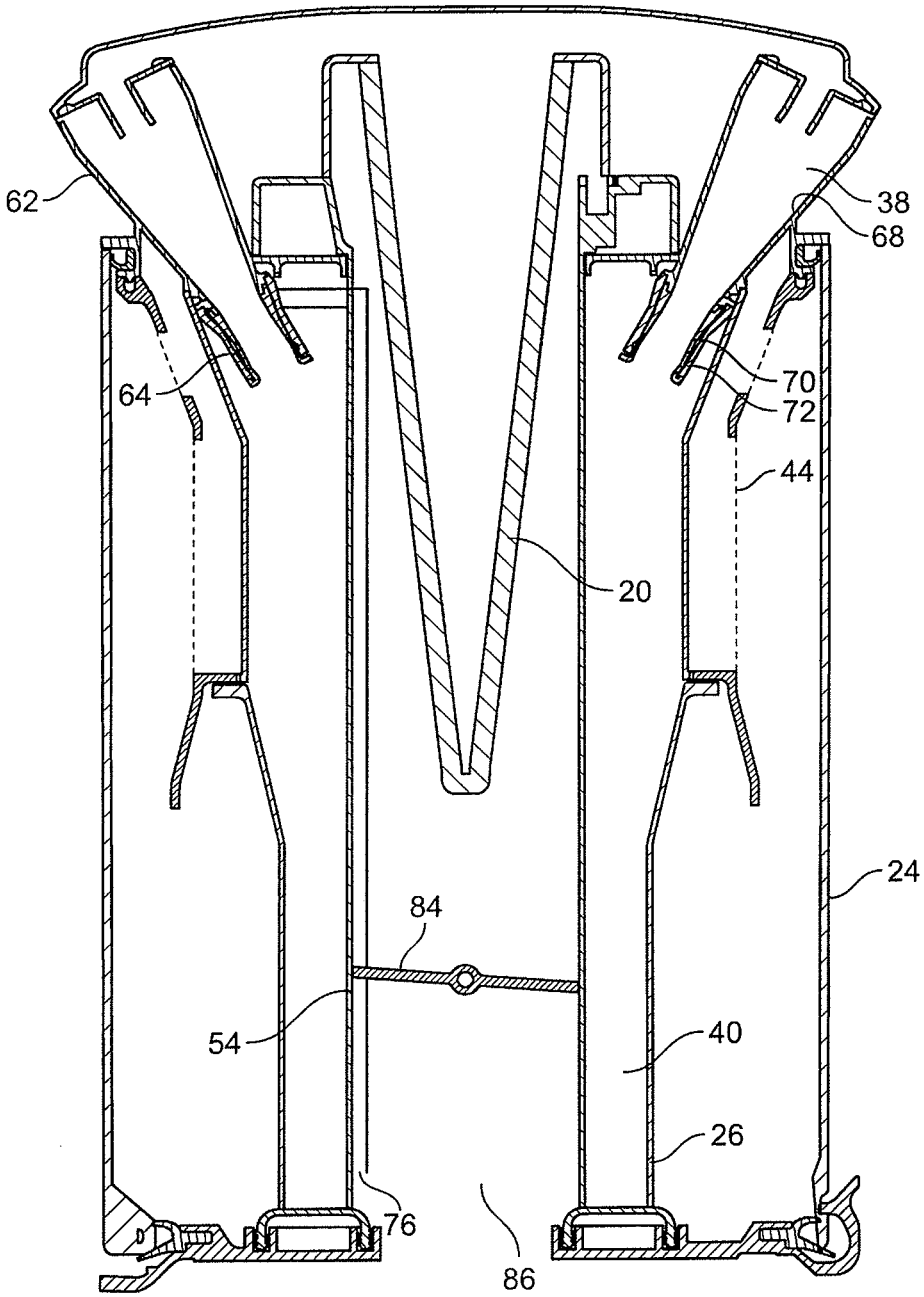
FIG. 7*b* shows a section through this cyclonic separating apparatus showing the flexible tips in their dilated state.

In the embodiment shown in FIGS. 7*a* and 7*b* a control valve 84 is located in a pre motor filter housing 86 to allow instantaneous dilation of the flexible tips 64 at any time. The control valve 84 can be operated by any suitable electrical or mechanical means at a prescribed time interval. For example the control valve 84 may be controlled by an air muscle or mechanical means connected to the on/off switch of the vacuum cleaner 1. The normal operating condition of a vacuum cleaner is shown in FIG. 7*a*. During normal operation the control valve 84 is open and therefore the second dust collecting chamber 40 will be at around 9 kPa below atmospheric pressure. There will be a similar pressure inside the secondary cyclones 38 themselves. In order to prevent the flexible tips 64 from inflating and blocking the dirt outlets 58, the pressure in the tip chamber 74 has to be equalized with the pressure inside the second dust collecting chamber 40 and the pressure inside the secondary cyclones 38. Again this is achieved by connecting the tip chambers 74 to a similarly low pressure. Thus the tip chambers 74 are fluidly connected to a pressure tap 76 which is located downstream of the pre motor filter 20.

During normal operation of the vacuum cleaner 1, the pressure difference between the second dust collecting chamber 40 and the pressure tap 76 is normally around 1.5 kPa, (which is equal to the pressure drop across the pre motor filter 20). This has the effect of applying a very slight dilation force to the flexible tips 64, but not enough to significantly deform them. Thus while the vacuum cleaner 1 is in operation and the control valve 84 is open the flexible tips 64 will be in the relaxed position.

When desired, for example when the vacuum cleaner 1 is switched off, the control valve 84 can be closed as shown in FIG. 7*b*. Closing the control valve 84 restricts the airflow through the secondary cyclones 38 and creates a large pressure drop inside the tip chambers 74 which will remain below atmospheric pressure while the second dust collecting chamber 40 and the secondary cyclones 38 return to atmospheric pressure. This causes the flexible tips 64 to dilate into the position shown in FIG. 7*b*. Once the flexible tips 64 have been dilated to help clear any trapped dirt, the control valve 84 can be returned to the open position shown in FIG. 7*a* so that the flexible tips 64 return to their relaxed state.

Figure 8:
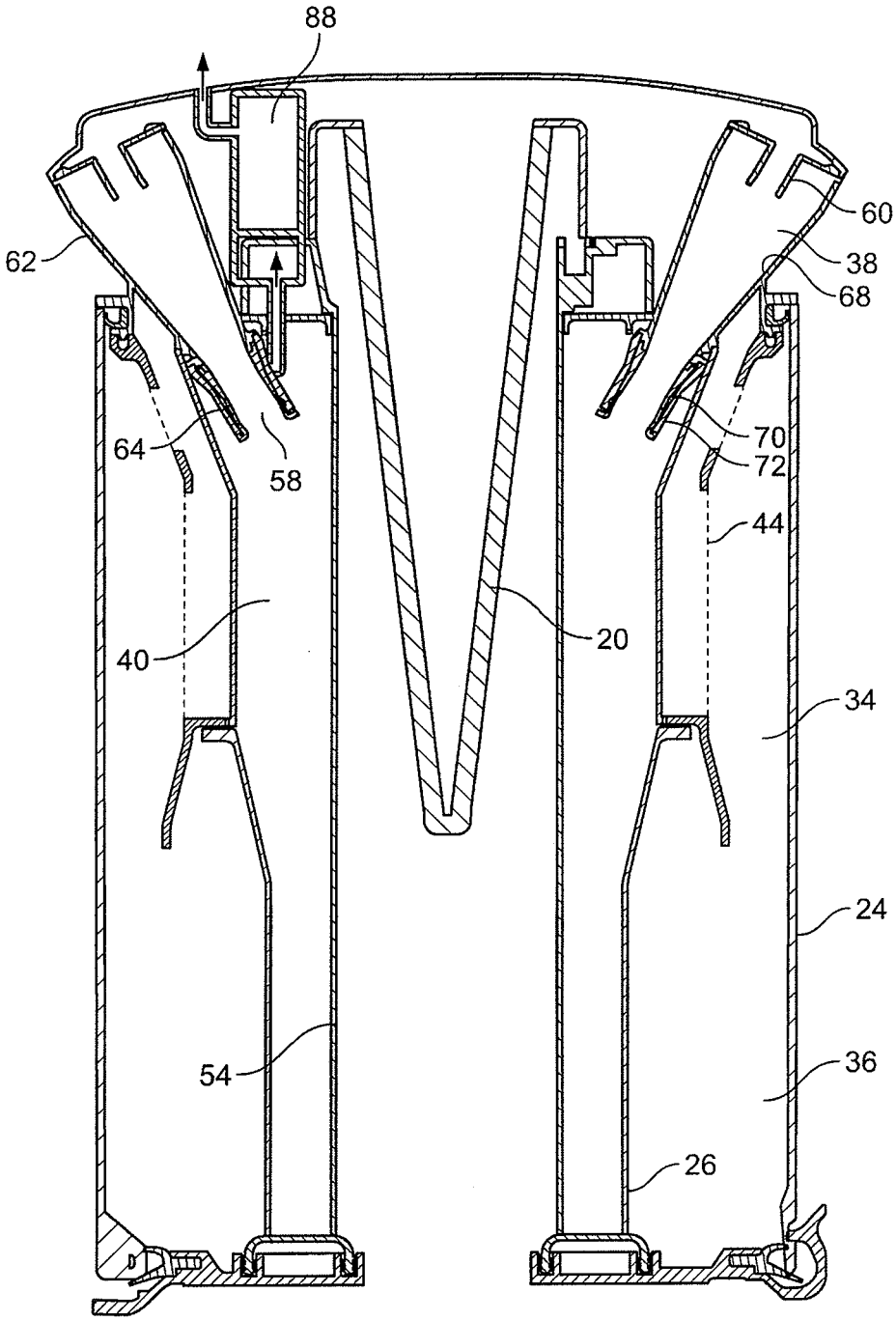
FIG. 8 shows a section through a sixth embodiment of a cyclonic separating apparatus with an electro mechanical pump for controlling dilation of the flexible portion of the cyclones, the flexible tips being shown in their dilated state.

In the embodiment shown in FIG. 8 a controlled electro-mechanical pump 88 is arranged to remove the air around the flexible tip 64 to draw open the flexible tips 64 into the dilated position. The electro-mechanical pump 88 can be controlled at any specific time interval or its action could be related to the removal of the cyclonic separating apparatus 10 from the main body 2 of the vacuum cleaner 1. Alternatively control of the electro-mechanical pump 88 could be related to the switching on or switching off of the vacuum cleaner 1.

Figure 9A:
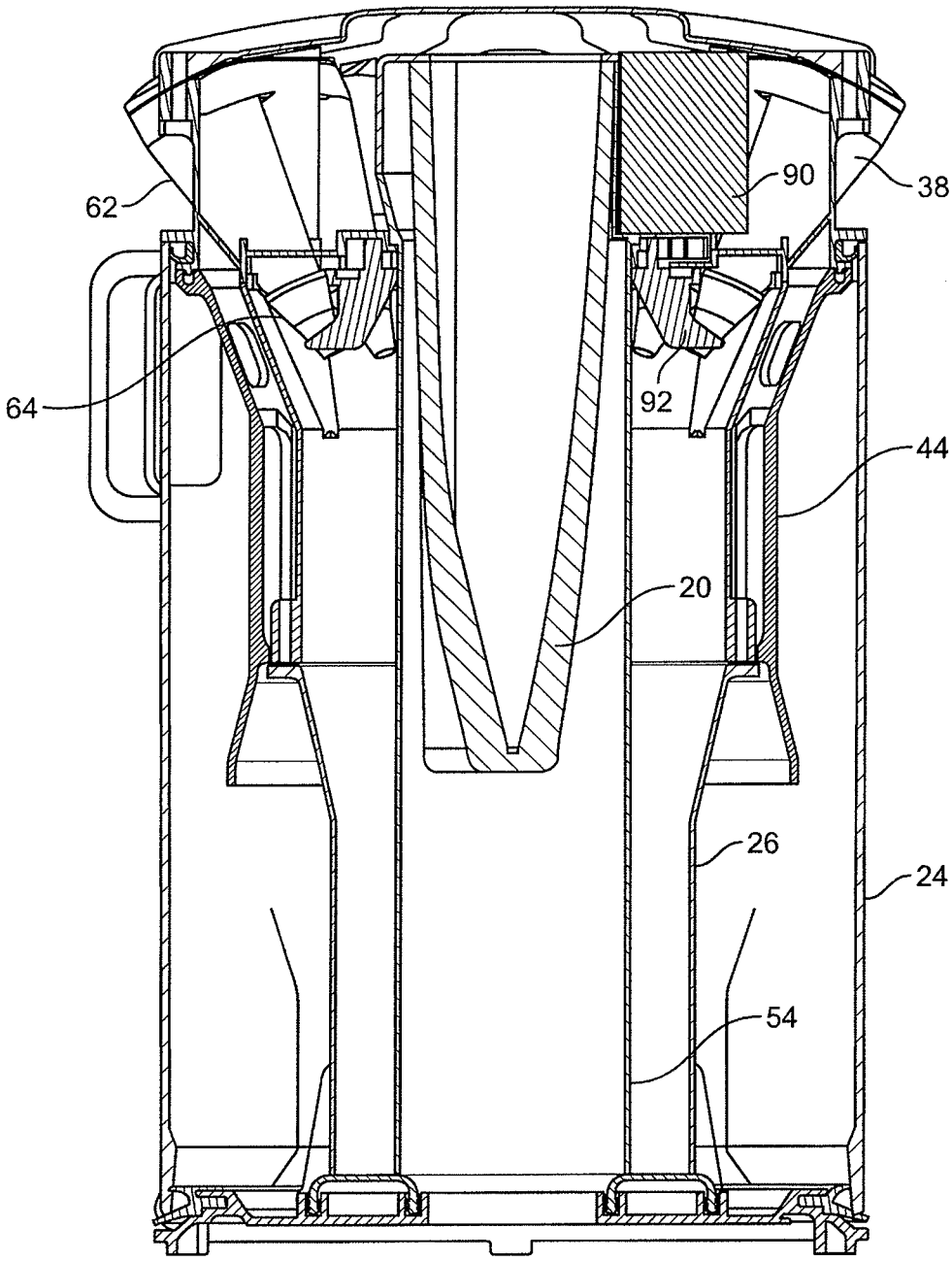
FIG. 9*a* shows a section through a seventh embodiment of a cyclonic separating apparatus with a motorized paddle for flicking the flexible tips of each cyclone.
Figure 9B:
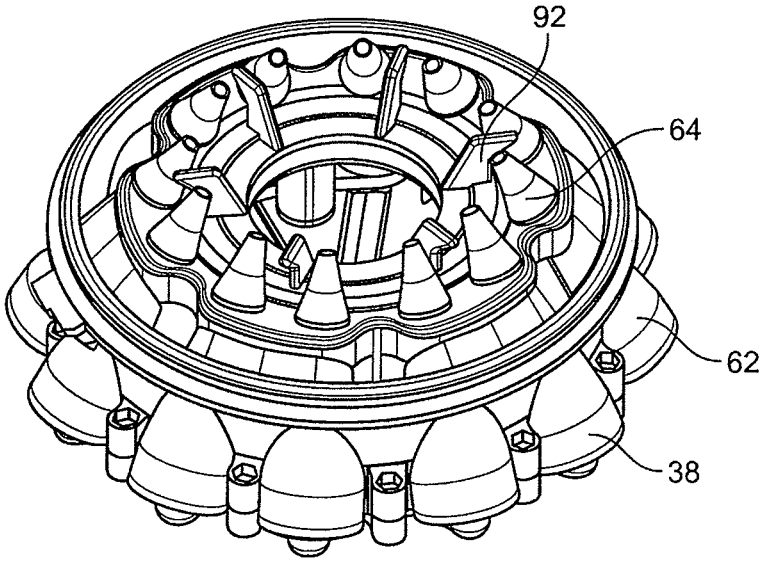
FIG. 9*b* shows an inverted perspective view of the cyclones and paddle of this cyclonic separating apparatus.
Figure 9C:
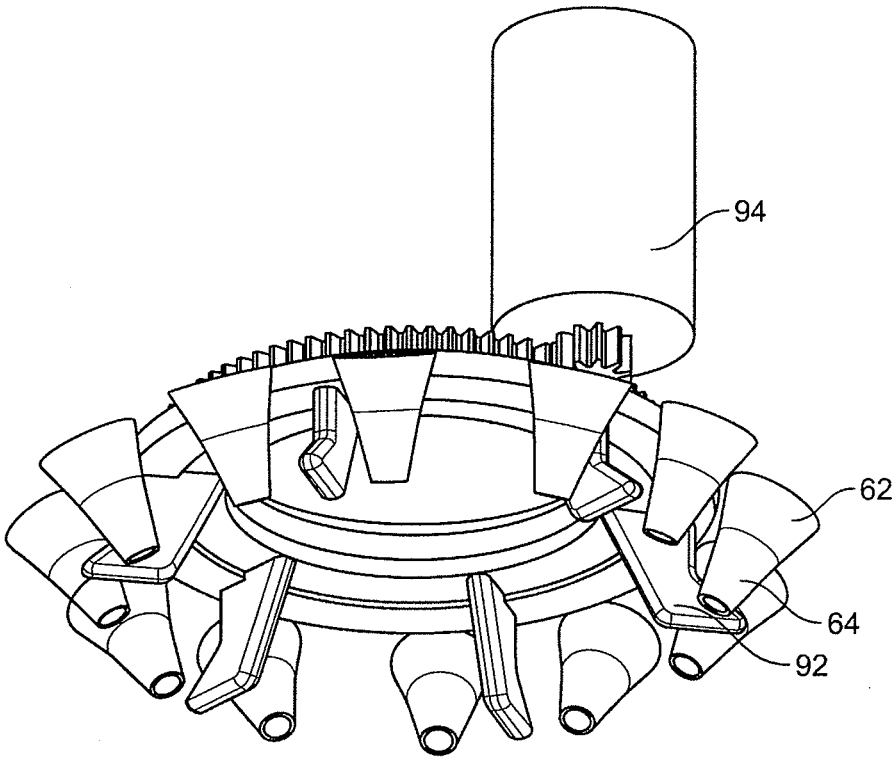
FIG. 9*c* shows a perspective view from underneath of a ratchet mechanism for turning the paddles shown in FIG. 9*b*.

In the embodiment shown in FIGS. 9*a* to 9*c* the secondary cyclones 38 have a rigid upper portion 62 and a flexible tip 64. In addition the vacuum cleaner 1 comprises a plurality of paddles 92 which are arranged such that they can strike, flick or wipe the flexible tips 64. A large mechanical movement may be used to draw the flexible tips 64 relatively slowly to one side. As the paddles 92 move beyond the flexible tips 64 the flexible tips 64 will be released. Due to the material properties of the flexible tips 64 this action helps to accelerate the movement of the flexible tips 64 and allows them to flick back to the resting position with a series of fast vibrating oscillations. During this action, any dirt caught in the flexible tips 64 may be disrupted, dislodged from the inner surfaces 68 of the secondary cyclones 38 and drop into the second dust collecting chamber 40. FIG. 9*a* shows an electric motor 90 which is arranged to move the paddles 92 relative to the secondary cyclones 38. In this embodiment the paddles 92 are arranged to move in a circle such that they flick the flexible tip 64 of each of the secondary cyclones 38 in turn. In FIG. 9*c* a ratchet device 94 for turning the paddles 92 relative to the secondary cyclones 38 is shown. Such a ratchet device 94 may be connected to an air muscle, or alternatively operated on removal or replacement of the cyclonic separating apparatus 10 on the main body 2 of the vacuum cleaner 1.

Figure 11A:
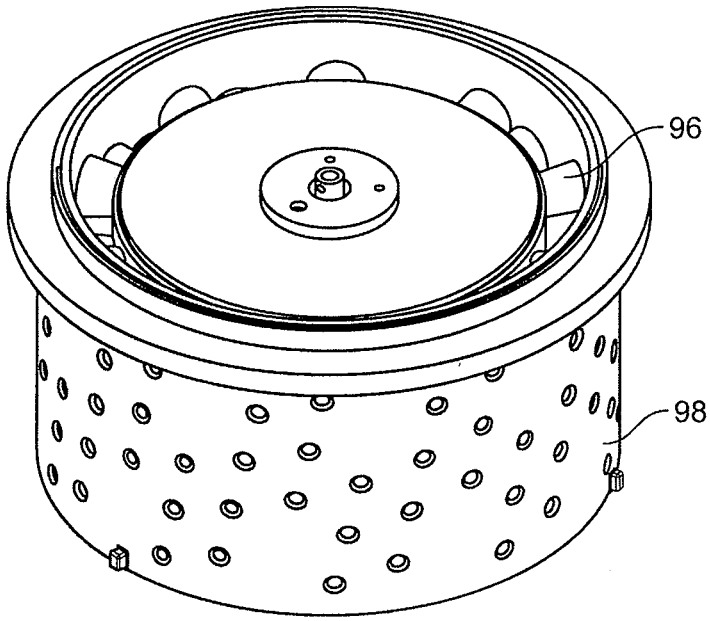
FIG. 11*b* shows a section through this cyclonic separating apparatus, showing a plurality of layers of cyclones stacked to form a column of cyclones.
FIG. 11*c* shows a section taken along line B-B shown in FIG. 11*b* showing a paddle for knocking the flexible tips.
Figure 11B:
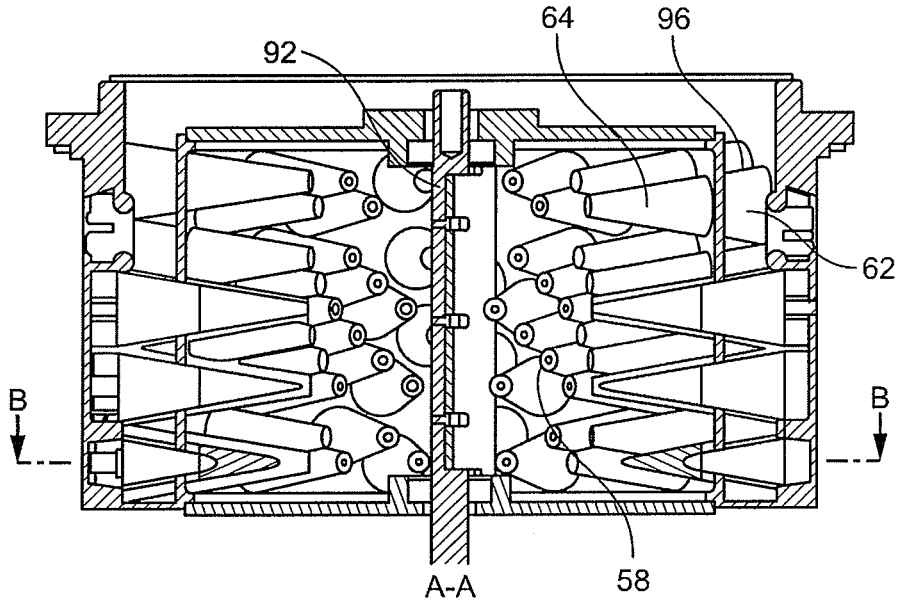
Figure 11C:
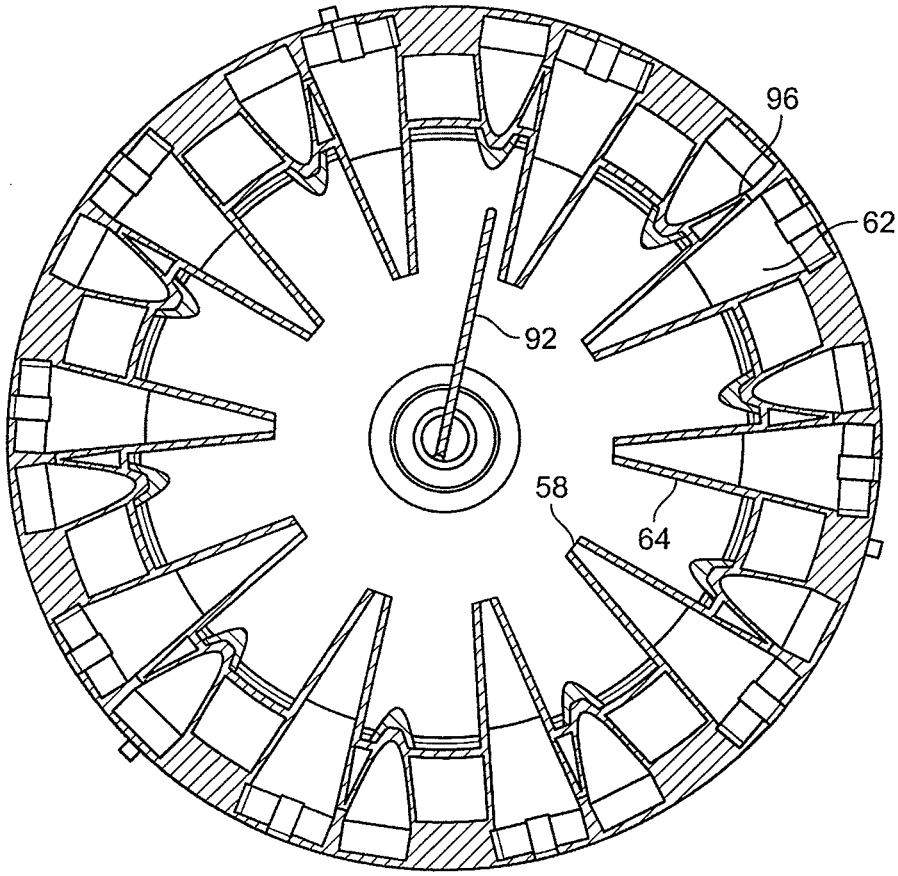
Figure 12:
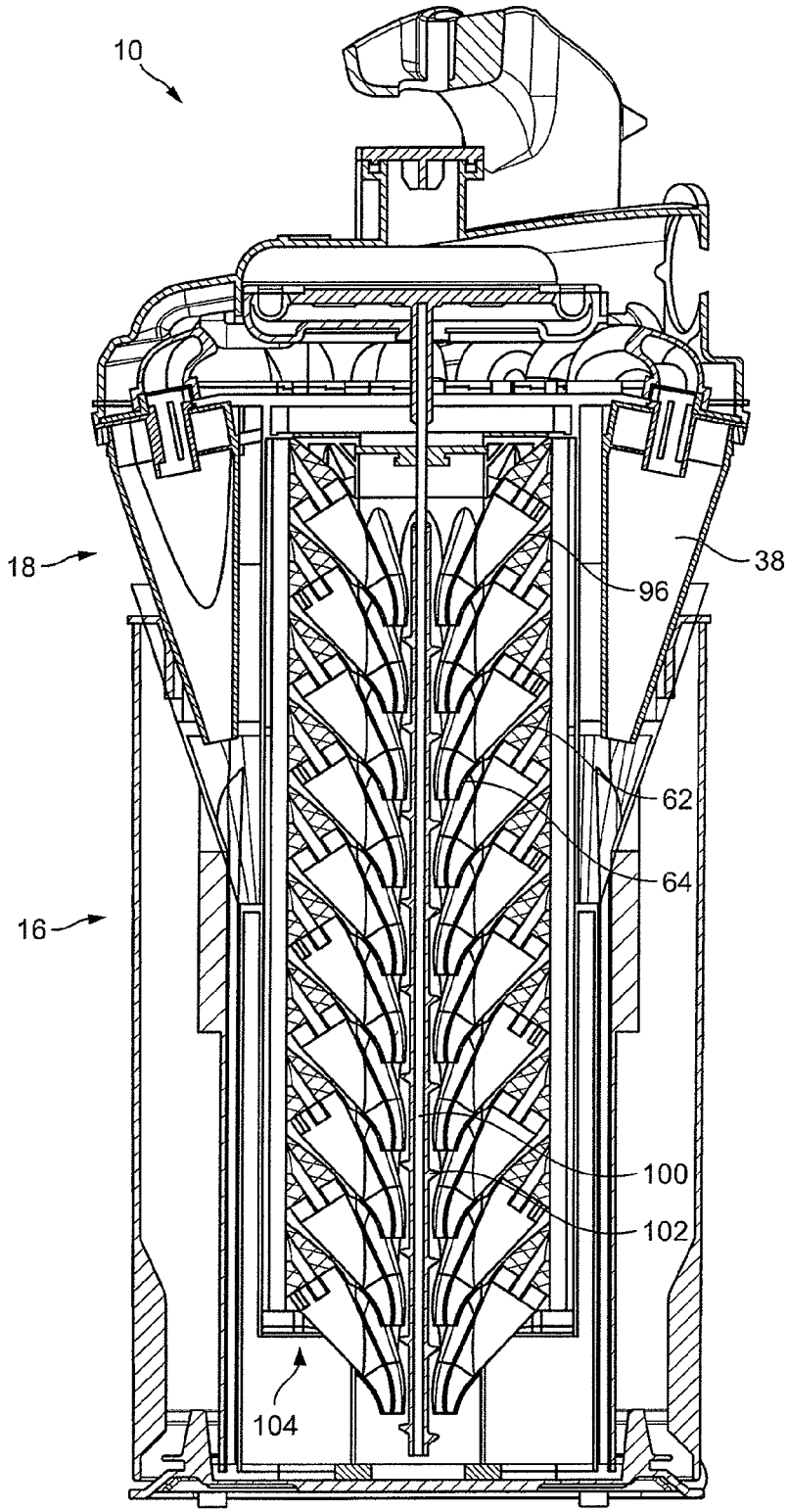
FIG. 12 shows a section through a tenth embodiment of a cyclonic separating apparatus where a plurality of layers of cyclones are stacked to form a column of cyclones, the cyclones being inclined and where the flexible tips are shaped away from the longitudinal axis of the rigid portion.

Alternative constructions of cyclonic separating apparatus 10 and cyclones 96 according to the present invention are shown in FIGS. 10 to 12. In each of these embodiments each of a plurality of cyclones 96 has a rigid portion 62 and a flexible tip 64.

Figure 10A:
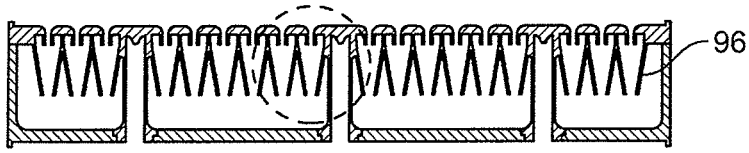
FIG. 10*a* shows a section through an eighth embodiment of a cyclonic separating apparatus having a plurality of cyclones arranged in parallel, each cyclone having a flexible portion.
Figure 10B:
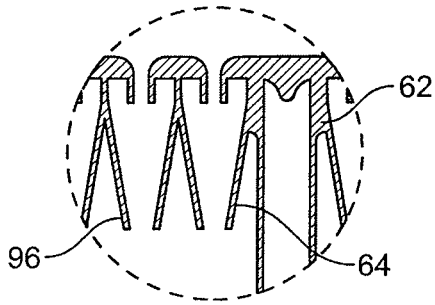
FIG. 10*b* shows a close up of the section circled in FIG. 10*a*.
Figure 10C:
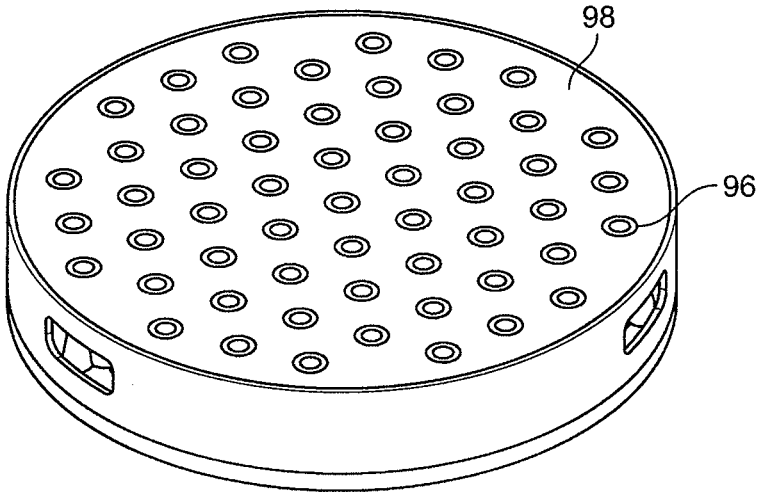
FIG. 10*c* shows a perspective view from above of the cyclones of FIGS. 10*a* and 10*b* in the form of a removable filter cartridge, FIG. 11 a shows a perspective view of a ninth embodiment of a cyclonic separating apparatus where the cyclones are arranged in a circle with their dirt outlets pointing substantially inwardly.

FIGS. 10*a* and 10*b* illustrate a plurality of cyclones 96 arranged in parallel in terms of airflow through the cyclones 96. The plurality of cyclones 96 are also arranged such that they are physically in parallel with each other. In this embodiment the plurality of cyclones 96 form the filter cartridge 98, shown in FIG. 10*c*, which may be removable from the remainder of the vacuum cleaner 1 for cleaning or replacement if desired. In FIGS. 10*a* and 10*b* the plurality of cyclones 96 are orientated such that their longitudinal axes are parallel with each other.

In an alternative embodiment shown in FIGS. 11*a* to 11*c*, the cyclones 96 are arranged in an annular arrangement with their dirt outlets 58 pointing substantially inwardly. The cyclones 96 are orientated such that their longitudinal axes are horizontal or substantially horizontal. In this embodiment the cyclones 96 form a filter cartridge 98, which may be removable from the remainder of the vacuum cleaner 1 for cleaning or replacement.

In FIG. 12 the cyclones 96 are orientated such that their longitudinal axes are inclined and the flexible tips 64 are shaped away from the longitudinal axis of the rigid portion 62.

In the embodiments shown in FIGS. 11 and 12 a plurality of layers or sets of cyclones 96 are stacked to form a column of cyclones 96 arranged with a parallel airflow path through each of the cyclones 96. In FIG. 12, the sets of cyclones are spaced along the axis of the first cyclonic cleaning stage 16. In these embodiments, the vacuum cleaner 1 comprises a moving means for knocking and/or brushing the flexible tips 64. In FIG. 11 the moving means is a paddle 92 which is arranged to sweep about a circular path to engage and release sequentially the flexible tips 64. In FIG. 12 the moving means is a rod 100 which has a plurality of projections 102 arranged around and along its length. This rod 100 is arranged such that it can move relative to the flexible tips 64. In the embodiment shown the rod 100 is arranged to move up and down such that each projection flicks a flexible tip 64 in order to help remove any dust located in the flexible tip 64. If desired air muscle activation could be used to drive movement of the rod 100. In this embodiment, the cyclones 96 are arranged as a third stage of cyclonic separation 104. These cyclones are therefore arranged downstream of the secondary cyclones 38 in place of the pre motor filter.

In order to determine whether a portion of a cyclone is "flexible" or "rigid" one or both of the following tests may be performed.

Test 1

Figure 13A:
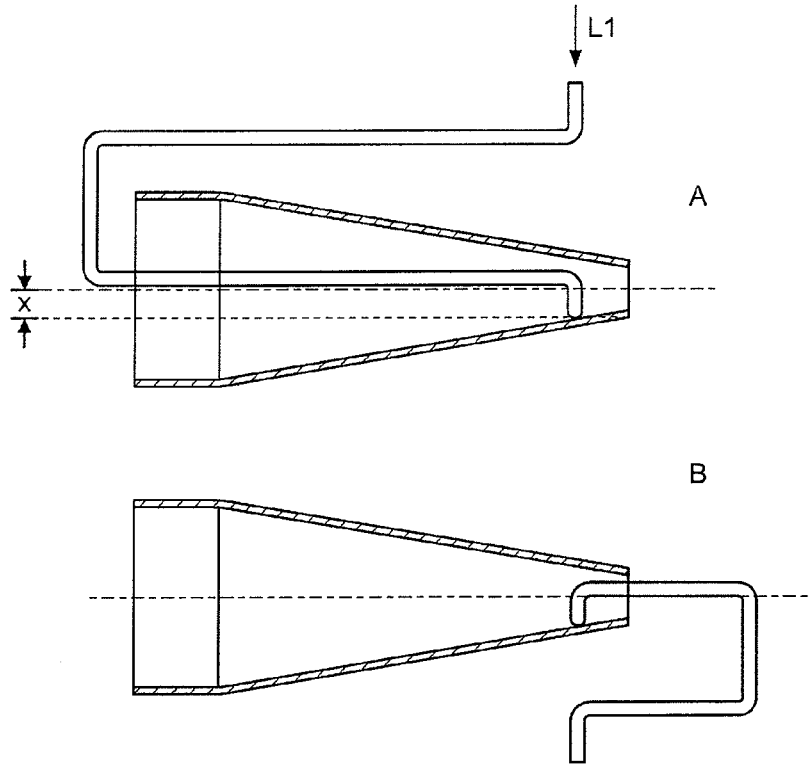
FIG. 13*a* shows how the flexibility of a portion of a cyclone can be tested using Test 1 with a 2 mm diameter stylus with a 1 mm radius at the tip, with A and B illustrating alternative stylus shapes.
Figure 13B:
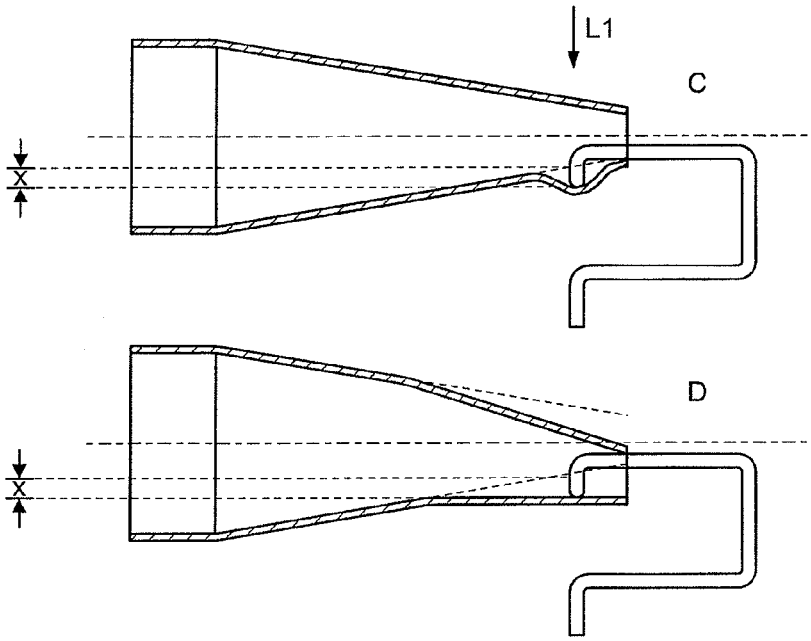
FIG. 13*b* shows the deflection of a flexible tip in Test 1 when a load is applied to a point on the inner surface of the cyclone.

The flexibility of a portion of the cyclone can be tested using a 2 mm diameter stylus with a 1 mm radius at the tip. The stylus can be shaped as A or B, as shown on FIG. 13*a*. The stylus is used to apply a Load L1 of 20 N to a point on the inner surface of the cyclone. The deflection of the cyclone surface is then ascertained. The shape distortion can be as C or D in FIG. 13*b* at any point on the inner surface of the cyclone. A deflection (X) of at least 1 mm is taken to mean that the portion of the cyclone being tested is flexible. A deflection of less than 1 mm is taken to mean that the portion of the cyclone being tested is rigid.

Test 2

Figure 13C:
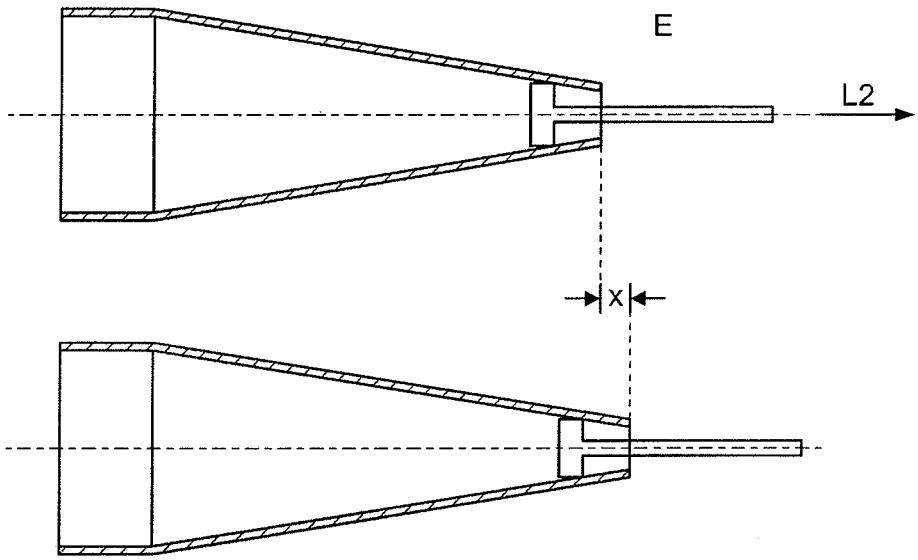
FIG. 13*c* shows how the flexibility of a portion of a cyclone can be tested using Test 2 where a wedge tool is used to apply a load to a tip of the cyclone.

A wedge tool as shown at E in FIG. 13*c* is used to apply a load L2 of 50 N. The elongation of the cyclone is measured. A deflection (X) of at least 1 mm is taken to mean that the portion of the cyclone being tested is flexible. A deflection of less than 1 mm is taken to mean that the portion of the cyclone being tested is rigid.

The invention claimed is:

1. A surface treating appliance comprising a plurality of frusto-conical cyclones arranged in parallel and each having a relatively wide rigid frusto-conical portion and a relatively narrow flexible frusto-conical portion connected to the relatively wide rigid frusto-conical portion, the relatively wide rigid frusto-conical portion comprising at least one dirty air inlet and the relatively narrow flexible frusto-conical portion comprising a dirt outlet.

2. The surface treating appliance of claim 1, wherein the flexible portion has a Shore A value of up to 60 Shore A.

3. The surface treating appliance of claim 1, wherein the rigid portion has a Shore D value of above 60.

4. The surface treating appliance of claim 1, wherein the flexible portion of each cyclone is arranged to vibrate as airflow moves through the surface treating apparatus during use.

5. The surface treating appliance of claim 1, comprising a system for moving the flexible portion of each cyclone.

6. The surface treating appliance of claim 5, wherein the system is arranged to move the flexible portion of each cyclone by one of dilation, inflation, deformation and compression of the flexible portion.

7. The surface treating appliance of claim 1, wherein the plurality of cyclones form at least a part of a filter cartridge which may be removable from the remainder of the surface treating appliance.

8. The surface treating appliance of claim 1, wherein the cyclones are arranged about an axis.

9. The surface treating appliance of claim 8, wherein the cyclones are oriented such that their longitudinal axes are substantially parallel to said axis.

10. The surface treating appliance of claim 8, wherein the cyclones are oriented such that their longitudinal axes extend towards said axis.

11. The surface treating appliance of claim 8, wherein the plurality of cyclones is divided into at least a first set of cyclones and a second set of cyclones, the first set of cyclones being spaced along said axis from the second set of cyclones.

12. The surface treating appliance of claim 1, comprising a cyclonic separating apparatus comprising a first cyclonic cleaning stage and a second cyclonic cleaning stage located downstream from the first cyclonic cleaning stage and comprising the plurality of cyclones.

13. The surface treating appliance of claim 1, wherein the flexible portion of each cyclone is connected to the rigid portion of that cyclone so that the internal interface between the flexible portion and the rigid portion is smooth.

14. The surface treating application of claim 1, wherein the flexible portion of each cyclone is over-molded on to the rigid portion of that cyclone.

15. The surface treating appliance of claim 1, further comprising one or more rigid cyclones.

16. The surface treating appliance of claim 1 in the form of a vacuum cleaner.

* * * * *